US012759759B2

(12) United States Patent
Seidler

(10) Patent No.: US 12,759,759 B2
(45) Date of Patent: Oct. 13, 2026

(54) MODULAR DEVICE WITH SEPARATABLE ENCASEMENTS

(71) Applicant: Concept Workshop Worldwide, LLC, New York, NY (US)

(72) Inventor: Stewart H. Seidler, Acton, MA (US)

(73) Assignee: CONCEPT WORKSHOP WORLDWIDE, LLC, New York, NY (US)

( * ) Notice: Subject to any disclaimer, the term of this patent is extended or adjusted under 35 U.S.C. 154(b) by 684 days.

(21) Appl. No.: 17/976,795

(22) Filed: Oct. 29, 2022

(65) Prior Publication Data

US 2023/0137303 A1 May 4, 2023

Related U.S. Application Data

(60) Provisional application No. 63/273,150, filed on Oct. 29, 2021.

(51) Int. Cl.
*A45D 33/26* (2006.01)
*B65D 21/08* (2006.01)

(52) U.S. Cl.
CPC ..... *B65D 21/083* (2013.01)

(58) Field of Classification Search
CPC ..... B65D 21/083; A45C 13/02; A45D 33/26
See application file for complete search history.

(56) References Cited

U.S. PATENT DOCUMENTS

| | | | | |
|---|---|---|---|---|
| 6,041,935 | A * | 3/2000 | Yang | A45D 40/22 220/4.27 |
| 6,070,749 | A * | 6/2000 | Joulia | A45D 40/221 220/817 |
| 6,138,686 | A * | 10/2000 | Yuhara | A45D 33/006 206/823 |
| 6,302,120 | B1 * | 10/2001 | Kuo | A45C 11/00 132/295 |
| 7,464,819 | B2 * | 12/2008 | Maietta | B65D 83/0463 206/536 |
| 10,327,572 | B2 | 6/2019 | Seidler | |
| 10,638,859 | B2 | 5/2020 | Seidler | |
| 10,882,661 | B1 | 1/2021 | Seidler | |
| 2021/0100333 | A1 | 4/2021 | Seidler et al. | |
| 2021/0153621 | A1 | 5/2021 | Seidler | |

* cited by examiner

*Primary Examiner* — Andrew D Perreault
(74) *Attorney, Agent, or Firm* — Carter, DeLuca & Farrell LLP; David C. Lee

(57) ABSTRACT

The present disclosure describes a modular primary device with removable product encasements. The device includes a removable encasement that is inserted into a modular unit. The device is configured such that it can connect to a second modular unit via connectors attached to the respective encasements. The user can open and close the device and, connect and disconnect one modular unit from an adjacent modular unit by manipulating the connectors which also act as hinges. The innovation is especially suitable for devices having portions composed of materials such as paper, wood, and glass, whose characteristics do not allow tight tolerance dimensioning.

19 Claims, 23 Drawing Sheets

FIG. 12 a-b
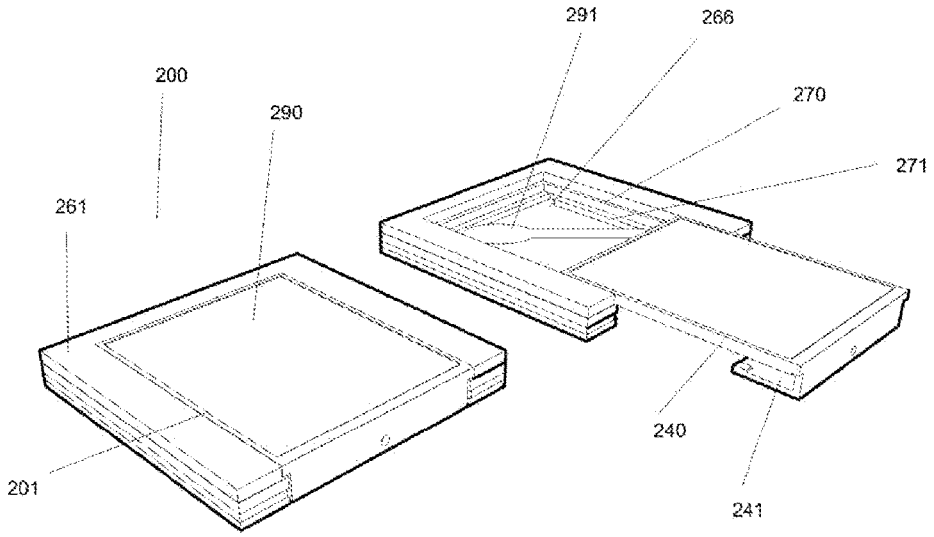
FIG. 12 a
FIG. 12 b
FIG. 13 a-b
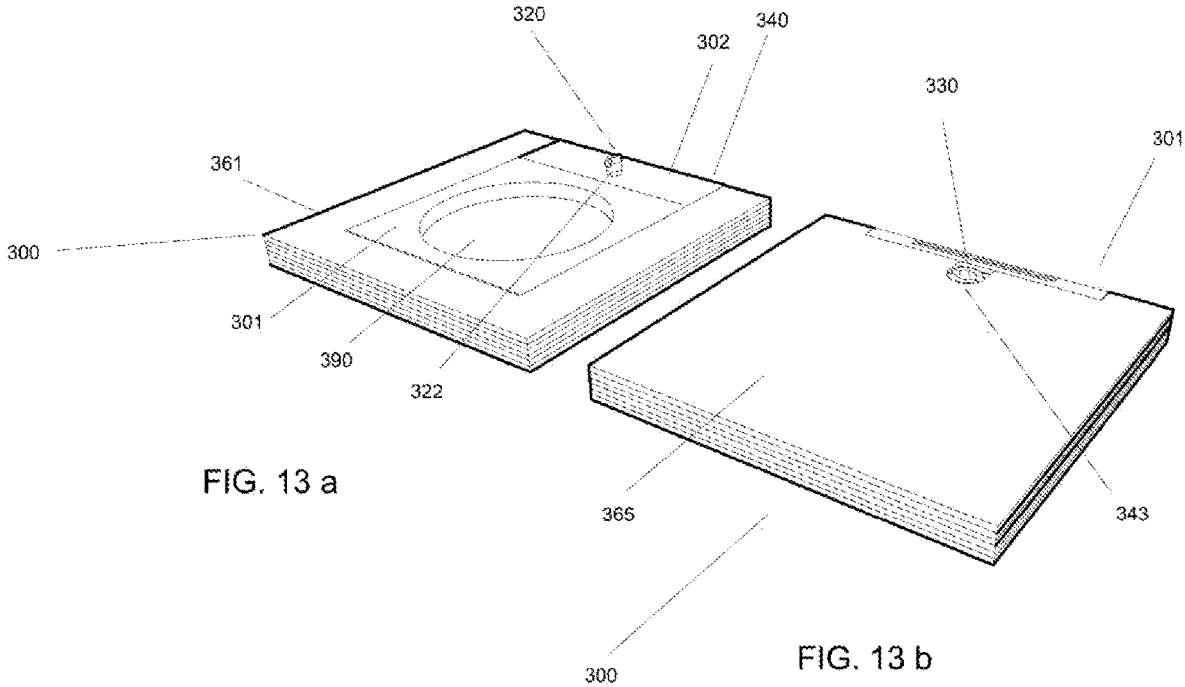
FIG. 13 a
FIG. 13 b FIG. 18 a-b
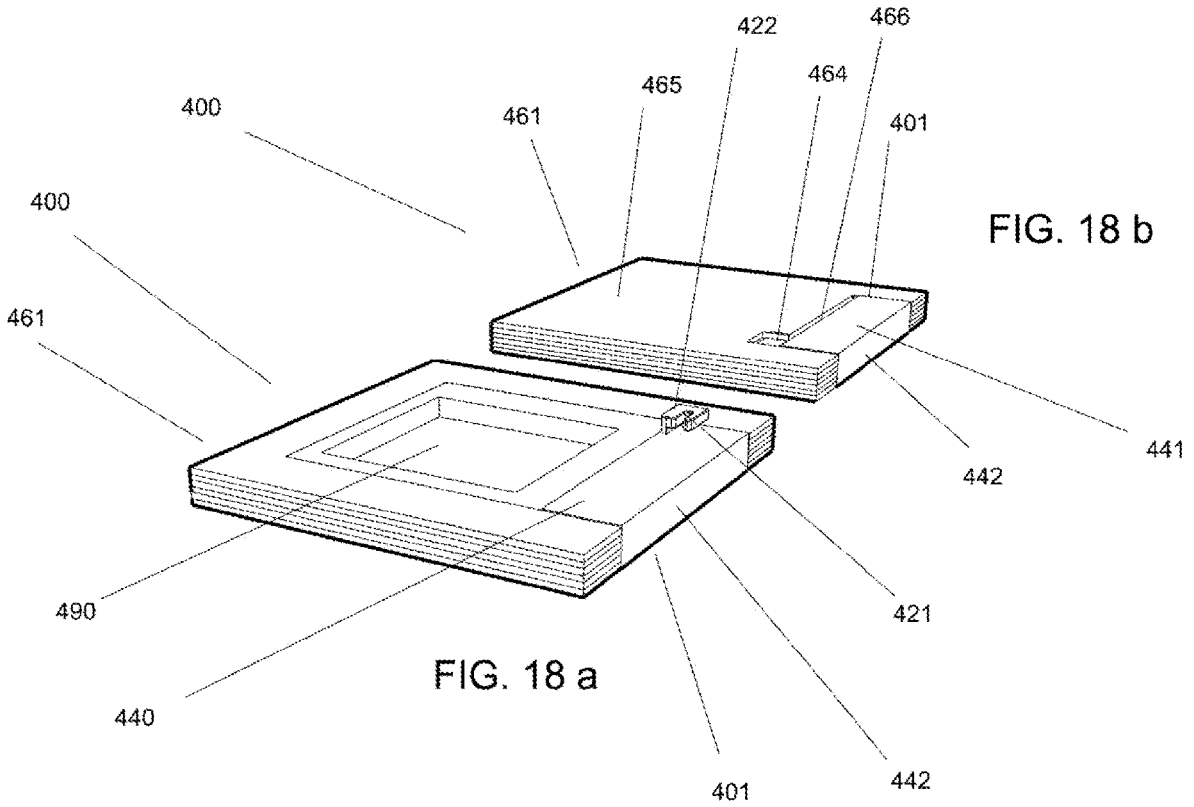
FIG. 18 b
FIG. 18 a
FIG. 19
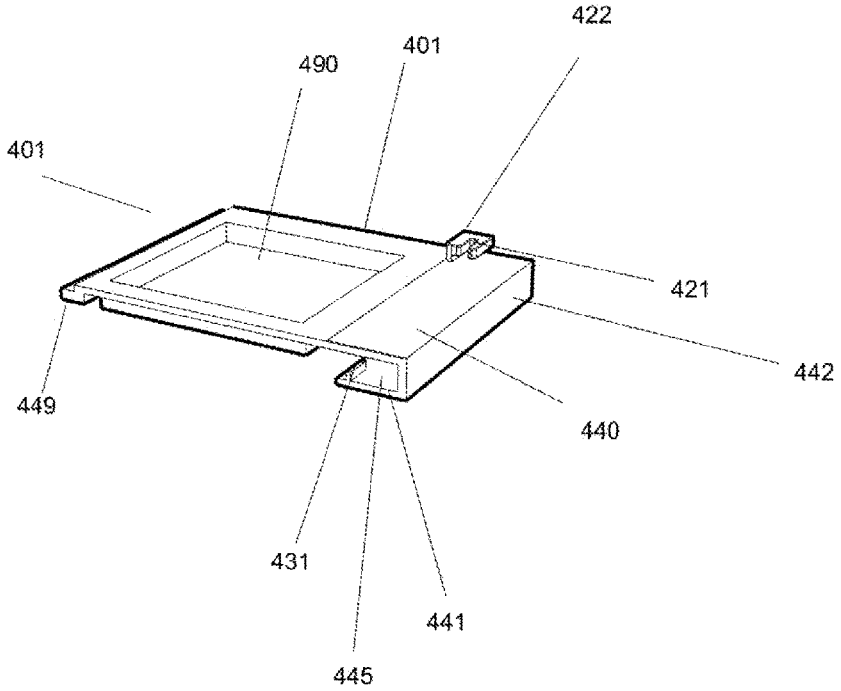

FIG. 22 a-b

FIG. 23 a-b
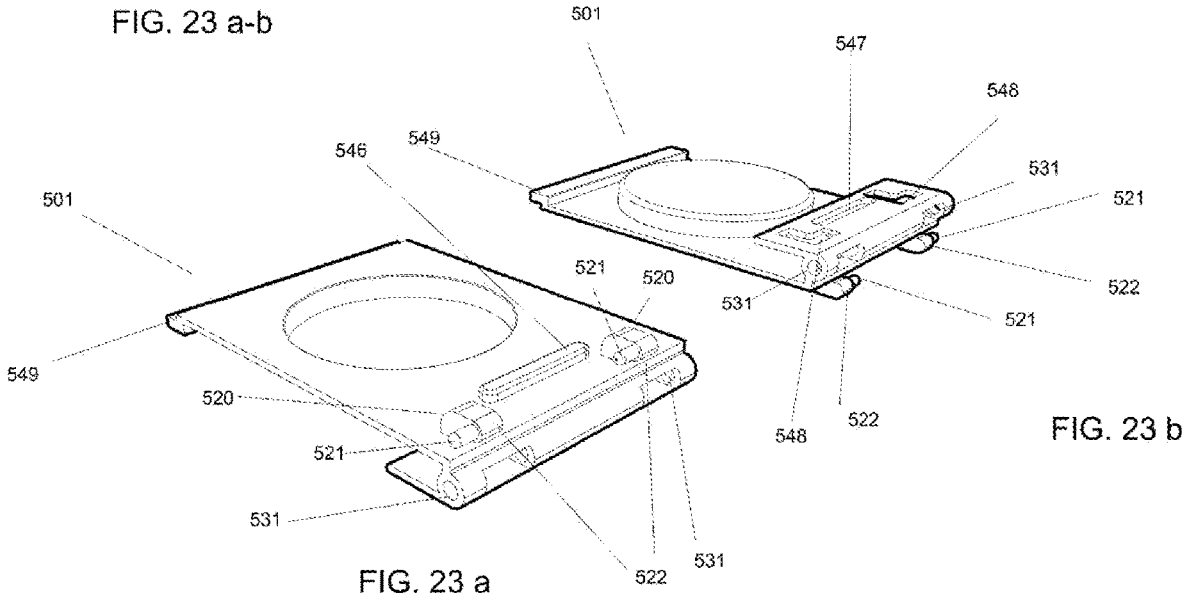
FIG. 23 b
FIG. 23 a
FIG. 24
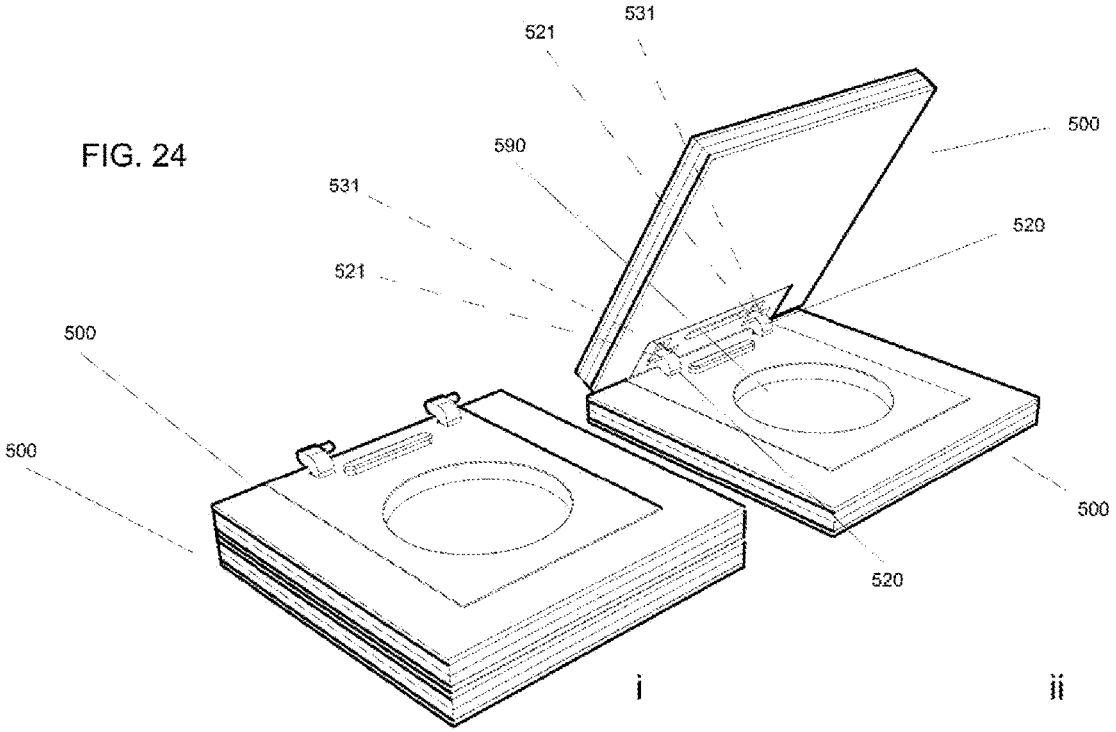

FIG. 26 a-b
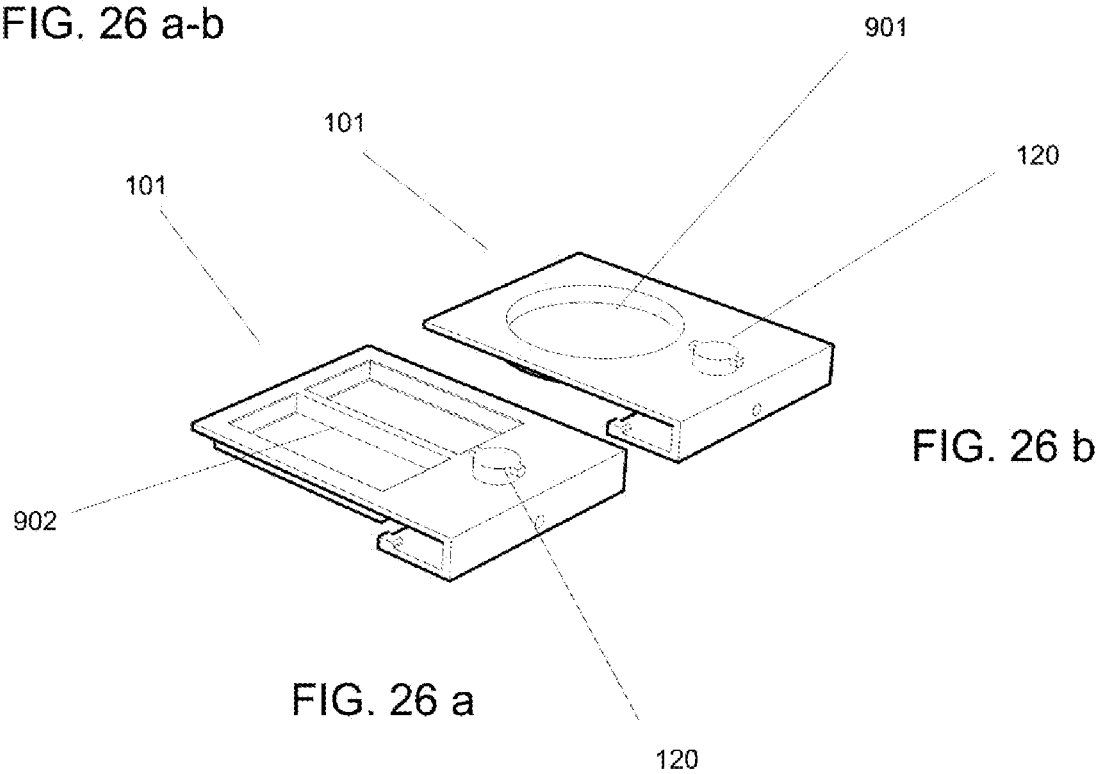
FIG. 26 b
FIG. 26 a
FIG. 27
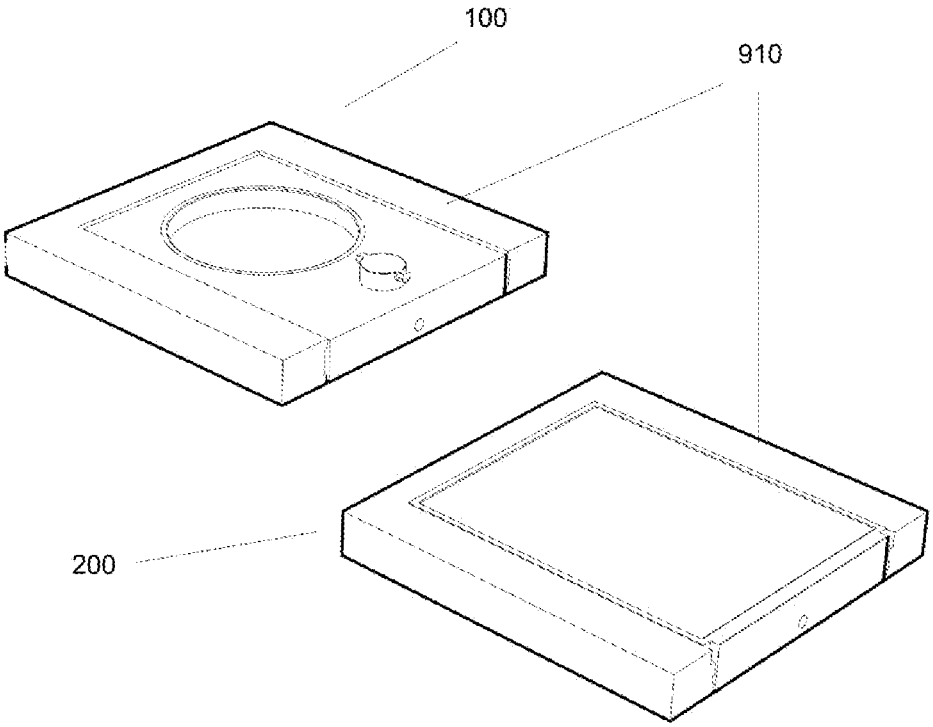

FIG. 30 a - b

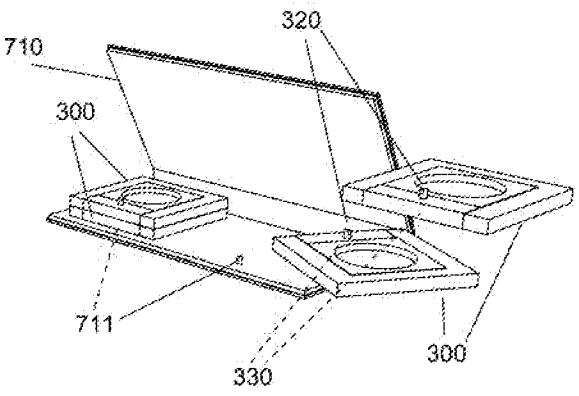
FIG. 32c
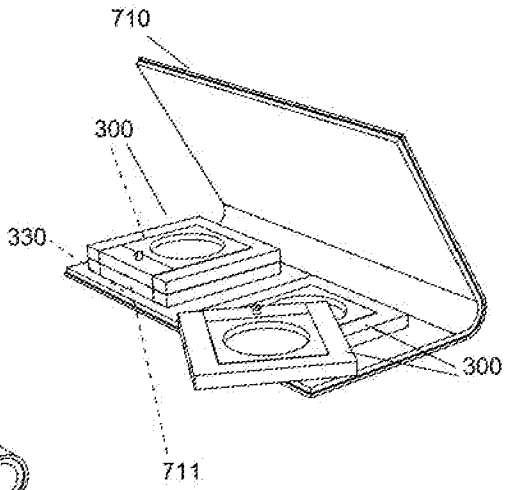
FIG. 32b
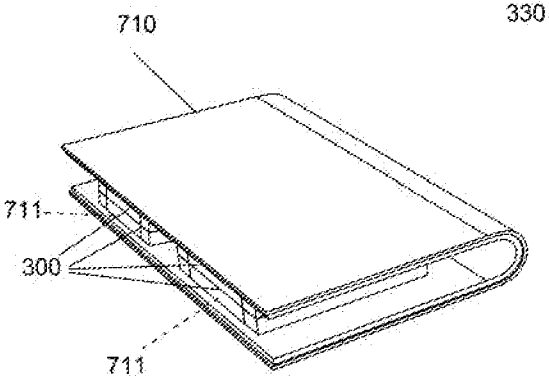
FIG. 32a
FIG. 32

MODULAR DEVICE WITH SEPARATABLE ENCASEMENTS

CROSS-REFERENCE TO RELATED APPLICATIONS

The present application claims the benefit of and priority to U.S. Provisional Application No. 63/273,150, filed Oct. 29, 2021, which is hereby incorporated by reference herein in its entirety.

TECHNICAL FIELD

The present disclosure relates to devices that store products, and more particularly, to a modular device that stores products in separatable encasements.

BACKGROUND

Consumers enjoy the ability to select or customize merchandise according to their individual tastes. In the case of products that are consumed or used up over time, the opportunity to try different varieties of products when one is used up can be exciting and gratifying. Such products should be packaged and delivered to users in a practical way, and users should be able to easily replace a used-up product in a device. Also, the device and packaging should allow for various kinds of construction materials and configurations to be incorporated into the device.

SUMMARY

The present disclosure relates to a modular device that stores products in separatable encasements.

In accordance with aspects of the present disclosure, a device includes a dock and an encasement. The dock includes a plurality of dock platforms and a dock space defined by the plurality of dock platform. The encasement includes an encasement upper platform, an encasement lower platform, an encasement side wall, at least one compartment configured to hold a product, a connector extending from the encasement upper platform, and an opening, where the connector and opening are complementary to each other. The encasement and the dock are couplable to each other in an assembled form and are uncouplable from each other. In the assembled form, the at least one compartment is positioned within the dock space and a periphery of the assembled form is defined by the encasement lower platform, the encasement upper platform, the encasement side wall, and outer portions of the plurality of dock platforms.

In various embodiments of the device, the plurality of dock platforms comprises a top platform, a bottom platform, a first intermediate platform defining a dock upper platform, and a second intermediate platform defining a dock lower platform. In the assembled form, the encasement upper platform abuts the top platform and the dock upper platform, and the encasement lower platform abuts the bottom platform and the dock lower platform.

In various embodiments of the device, in the assembled form, the dock space is bounded on top by the encasement upper platform of the encasement and bounded on bottom by the bottom platform of the dock.

In various embodiments of the device, the device includes a cover configured to be couplable to the dock and uncouplable from the dock. The cover includes an opening complementary to the connector of the encasement such that the opening of the cover is couplable to the connector of the encasement.

In various embodiments of the device, the encasement is configured to be disposed and the dock is configured to be reused with a new encasement.

In various embodiments of the device, the dock is made from at least one of: paper, wood, or glass.

In various embodiments of the device, the encasement is made from plastic.

In various embodiments of the device, the opening of the encasement is one of: an orifice formed in the encasement lower platform, an orifice formed by a post inside column extending from the encasement upper platform in a direction opposite from the connector, or a slide path formed by the encasement lower platform.

In various embodiments of the device, the connector of the encasement is one of: a column with pegs extending from the column, a slide latch, or a hinge column with a hinge pin extending from the hinge column.

In various embodiments of the device, the assembled form of the dock and the encasement form a first base layer, and the device further includes a second base layer. The second base layer includes a second dock and a second encasement. The second dock includes a second plurality of dock platforms and a second dock space defined by the second plurality of dock platforms. The a second encasement includes a second encasement upper platform, a second encasement lower platform, a second encasement side wall, at least one second compartment configured to hold a product, a second connector extending from the second encasement upper platform, and a second opening. The second opening is configured to couple with the connector of the encasement of the first base layer, and the second connector is configured to couple with the opening of the encasement of the first base layer. The second encasement and the second dock are couplable to and uncouplable from each other. The first base layer and the second base layer are couplable to each other in an assembled state and are uncouplable from each other by: coupling and uncoupling the connector of the encasement of the first base layer with the second opening, or coupling and uncoupling the opening of the encasement of the first base layer with the second connector.

In various embodiments of the device, in the assembled state, the first base layer and the second base layer are movable with respect to each other.

In various embodiments of the device, in the assembled state, the first base layer is rotatable or slidable with respect to the second base layer to expose the at least one compartment of the encasement of the first base layer for a user to access the product.

In various embodiments of the device, in the assembled state, the first base layer and the second base layer are rotatable to a first alignment in which the first base layer and the second base layer are in a same orientation, where the first base layer and the second base layer cannot be uncoupled in the first alignment.

In various embodiments of the device, in the assembled state, the first base layer and the second base layer are rotatable to a second alignment in which the first base layer and the second base layer are in different orientations, where the first base layer and the second base layer can be uncoupled in the second alignment.

In various embodiments of the device, in the assembled state, the first base layer and the second base layer are slidable to a first alignment in which the first base layer and the second base layer are fully stacked, where the first base layer and the second base layer can be uncoupled in the first alignment.

In various embodiments of the device, in the assembled state, the first base layer and the second base layer are slidable to a second alignment in which the first base layer and the second base layer are off-centered with respect to each other, where the first base layer and the second base layer cannot be uncoupled in the second alignment.

In various embodiments of the device, the at least one compartment of the encasement and the at least one second compartment of the second encasement have different configurations.

In various embodiments of the device, the assembled form of the dock and the encasement form a first base layer, and the device further includes a plurality of additional base layers. Each base layer of the plurality of additional base layers includes a respective dock substantially identical to the dock of the first base layer, and a respective encasement substantially identical to the encasement of the first base layer. Each base layer of the plurality of additional base layers is couplable to the first base layer or to any other base layer of the plurality of additional base layers.

In various embodiments of the device, the assembled form of the dock and the encasement form a first base layer, and the device further includes a second base layer. The second base layer includes a second dock substantially identical to the dock of the first base layer, and a second encasement substantially identical to the encasement of the first base layer. The second encasement includes a second connector substantially identical to the connector of the encasement of the first base layer, and a second opening substantially identical to the opening of the encasement of first base layer. The first base layer and the second base layer are couplable to each other in an assembled state and are uncouplable from each other by: coupling and uncoupling the connector of the encasement of the first base layer with the second opening, or coupling and uncoupling the opening of the encasement of the first base layer with the second connector.

In various embodiments of the device, the device includes a wallet configured to open and close. The wallet includes a connector, and the encasement is couplable to and uncouplable from the wallet by coupling and uncoupling the opening of the encasement with the connector of the wallet.

The details of one or more embodiments of the disclosure are set forth in the accompanying drawings and the description below. Other features, objects, and advantages of the techniques described in this disclosure will be apparent from the description and drawings, and from the claims.

BRIEF DESCRIPTION OF THE DRAWINGS

A detailed description of embodiments of the disclosure will be made with reference to the accompanying drawings, wherein like numerals designate corresponding parts in the figures.

FIG. 12*a-b* shows the closed and open position of a cover of the lock configuration, with encasement section serving instead as a slidable compartment.

FIGS. 13*a-b* shows top and bottom views of the relevant parts of a post connector configuration of a disclosed device.

FIGS. 18*a-b* shows top and bottom views of the relevant parts of a slide connector configuration of a disclosed device.

FIG. 19 is a top perspective view that shows detail of the encasement component of the configuration described in FIGS. 18*a-b*.

FIG. 23*a-b* is a perspective view that shows top and bottom detail of the encasement component of the configuration described in FIGS. 22*a-b*.

FIG. 24 shows a sequence describing how one base layer of the pin hinge configuration of the connector rotates open relative to a second layer.

FIGS. 26*a-b* shows a typical encasement component with different well configurations.

FIG. 27 shows a typical base and cover of a disclosed device showing the dock wrapped with paper.

FIGS. 32*a-c* show how the multiple modular bases can be accessed and removed from the wallet.

DETAILED DESCRIPTION

Figure 1:
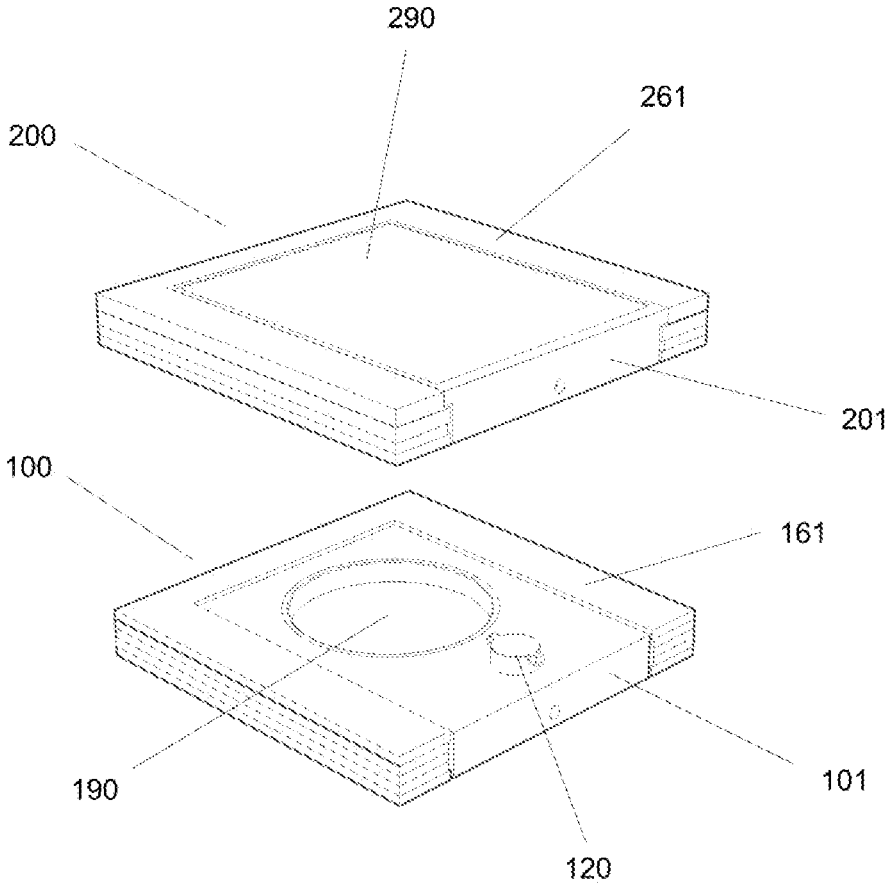
FIG. 1 shows a perspective view of a cover layer and a base layer of a disclosed device.

As used herein, the term "exemplary" does not necessarily mean "preferred" and may simply refer to an example unless the context clearly indicates otherwise. Although the disclosure is not limited in this regard, the term "plurality" as used herein may include, for example, "multiple" or "two or more". The term "plurality" may be used throughout the specification to describe two or more components, devices, elements, units, or the like. The terms "embodiment" and "configuration" may be used interchangeably, unless the context indicates otherwise. In the following description, the terms "encasement" and "refill" may be used interchangeably, unless indicated otherwise by the context.

The present disclosure relates to a modular device that stores products in separatable encasements. The present disclosure addresses improvements on three major features—the modularity of a device containing multiple products that can be easily separated from one another, the ability for the user to open and close the device in such a way as to allow access only to a specific product in the overall device, and the ability to remove the product itself from the overall device and then easily replace it with another. The present disclosure further addresses additional manufacturing and usability benefits such as reducing the overall amount of material required during the life of the device, reducing the cost of manufacturing the packaging, allowing the individual products, filled within encasements, to be easily replaced when the product is used up, and allowing for a convenient and environmentally friendly way to package the encasement so that they can be supplied to the user.

Modular packaging allows a user to assemble their own set of product units into one device. The products themselves are typically housed in a protective encasement which can be inserted into a modular unit. For example, a typical modular device may house a set of several color cosmetic products, each enclosed by a protective encasement such as a cosmetic pan made of plastic or metal which, in turn, is inserted into a modular unit. The encasement, in this case a pan, is usually snapped, magnetically attached, or permanently glued into a dimensionally compatible well formed in the modular unit. A set of these modular units are configured so that a user can build a device by attaching one unit to another unit and assemble them into a device. One way to attach the units to one another is via mutually attractable magnets that are embedded in each of the units. The units may also be assembled by mechanically snapping them into a larger case or box. Alternatively, the unit could be snapped together in some fashion Some of these modular units are configured so that the encasements can be separated from the modular unit. The supplying company may configure a device this way to allow the user to refill the device after the product has been used up without having to dispose the rest of the device. This saves both packaging costs and material.

One application example of a modular device with removable encasements would be a cosmetic makeup compact containing one or more cosmetic products. Some color cosmetic products such as eye makeup and blush, are poured or pressed into a metal or plastic pan. The pan is, in turn, inserted into a much larger palette device, or in the case of a modular configuration, into the modular unit.

In the case of a refillable device, the individual pans can be removed by ejecting them from the well by pushing it out from the bottom via a hole or prying them out from the top of the device, by using a tool such as a finger or pen. They are then replaced with new product-filled pans. This is an inconvenient or messy method as the cosmetic product can soil the fingers and worse, the product can itself be damaged during the operation. One of the objectives of the present disclosure is to provide a device that allows the encased product to be easily removed and replaced by the user. Another objective is to also provide configurations whereby a replaceable encased products can be mailed to the user safely while protecting the product from damage, and with minimal material and environmental costs.

A typical modular configuration of a cosmetic device is comprised of two or more modular units with the above-mentioned pans filled with products. This modular device might be made of a material which allows a dimensioning that allows tolerances of +/−0.1 mm or less. This allows for device configurations with fitted parts such as snaps or hinges. These configurations usually require tight tolerances, but they allow multiple modular units to securely fit together. Most plastics used in such configurations are not recyclable. Those that are recyclable generally are not aesthetically pleasing, nor function all that well. In various embodiments where multiple modular units are fitted together, the modular units may be substantially identical to each other. As used herein, the term "substantially identical" means and that devices or components are made to the same specifications but may be slightly dimensionally different due to manufacturing imperfections or limitations, among other factors. In various embodiments where multiple modular units are fitted together, some or all of the modular units may not be substantially identical and may have different configurations. In any case, modular units are couplable and uncouplable from each other.

Alternatively, the modular units in the devices just mentioned might be composed of a material such as paper, formed metal, wood, or glass. Such materials generally cannot be manufactured with tight tolerances but, they are favored as recyclable or compostable alternatives to plastic. Packaging entirely comprised of such materials cannot be efficiently configured with features that allow them to be snapped and hinged together in a modular fashion. One solution to this is to configure each modular unit to attach to the next via one or more magnets embedded into the layers. But magnets are expensive and not recyclable.

Any modular device should also be configured such that a user may easily access the product without having to unsnap the individual modular units. The user will avoid devices that are unwieldly to open or access product.

Though a makeup compact kit is used as the primary example in the present disclosure, there are many other applications. Some of those applications will be discussed below.

The following addresses improvements to the above-mentioned three primary features of the present disclosure. The first feature to address is the modularity of the disclosed device. Some devices contain multiple products which users purchase at the point of sale. In the case of modular devices, these products are supplied in separate units referred to below as modular units. In the typical modular device configuration, these units can be easily detached and reattached from each other. Two or more of these modular units can be attached together, perhaps with the addition of a protective modular cover, to form an assembled device. Advantages to this kind of configuration include the ability of a user to assemble their own set of products at the point of sale, into a usable product set that they would purchase and take home. Alternatively, if the device comprises multiple products where one product is used up before the other products, the user can easily separate the modular unit containing the spent unit and replace it with another modular unit containing unused product. Or, the user may keep various products stored at home, each in their modular unit. The user may then assemble a device set of products by attaching the various modular units together, along with a modular cover, and place it into a purse, backpack, toolbox, or other carrying case.

In the present disclosure, the modular connection occurs between the separatable encasements. An exemplary material of the encasement is a material such as plastic, with can be molded with a high degree of dimensional tolerance. The encasement is filled with the product. The encasement is then inserted into a modular unit made of a material such as paper. A second product-filled encasement which is inserted into a second modular unit is then connected to the first encasement via a connector. So, the connections are between connectors which are manufactured as a part of the encasement. The connector configuration will be discussed later. In the exemplary configuration, the volume of material required to manufacture the encasement is substantially less that the total material volume of the device.

Not only does the connector connect one modular unit to another modular unit, but it also allows one unit to open relative to the next without the need to completely detach the units. This constitutes the second feature of the present disclosure. The connector serves as a hinge. There are several types of hinges that are described below. One modular device opens in the fashion of a clamshell. The hinge moves as a standard pin hinge but can be disconnected by sliding one hinge component relative to the next and lifting it away. Another hinge configuration allows one modular unit to swivel relative to a second modular unit, about a common axis. It can be disconnected via a lock-and-key mechanism that is built into the rotating hinge. A third configuration allows one modular unit to slide open laterally relative to the second. These are examples of only three of the various possible hinge-connector variations that connect one encasement with another. These hinge configurations can also connect a modular unit to a cover or base that serves no other function than to protect the overall device.

The third feature of the present disclosure is the ability of the encasement, with the connector attached, to easily separate from the rest of the modular unit's body. In the exemplary configuration, the encasement slides into an inset built into the main body of the modular unit and locks together with the main body. A second method of fitting the encasement into the main body is to insert it into a main body hole so that it is secured together by virtue of a feature such as an undercut. In the exemplary configuration, the method for locking the encasement into the modular unit allows a removable and relatively rigid encasement with a tight dimensional tolerance to engage with a modular unit comprised of a material such as paper with a low dimensional tolerance.

In a typical modular device that relies on a mechanical means such as a snap or removable pin to connect individual modular units, components need to be made of a rigid, dimensionally tolerant material such as plastic. Though some plastics are partially recyclable or biodegradable, user brands frequently still require the packaging industry to use more environmentally friendly materials such as paper, wood, or even glass. Such materials do not lend themselves to tight tolerance dimensions. Therefore, it is difficult to configure a connecting mechanism or hinge because the tight tolerance required by such a mechanism cannot be met using low tolerance materials. Furthermore, materials such as paper, wood, and glass are expensive to manufacture. Though such materials are environmentally desirable and offer attractive configuration options, they are expensive. Their expense is reflected in the cost of the product. The brand may be reluctant to ask the user to throw such an expensive device away.

An example of an application of the present disclosure with the three features, mentioned above, is a cosmetic compact color makeup device that would contain two or more color products. Each product would be filled or inserted into a compartment (e.g., a well) molded into an encasement. The encasement would fit into a recess of the modular unit which could be made of an attractive and compostable material such as paper, or a reusable, long-lasting material such as ceramic or pressed glass, wood, or even an expensive, reusable plastic base.

As mentioned, these materials are difficult to manufacture with features that require the tight dimensions necessary for a hinge, snap or lock. They are also expensive. To solve this, the separatable part—the encasement—of the modular unit is made of an inexpensive material that allows for the tight tolerances necessary for this part, a hinge and connecting device. In most cases, a rigid or semi-rigid plastic such as polypropylene, ABS, PLA, or a PCR variation of such a material will meet the necessary material requirements. These materials frequently have the added feature of being recyclable or biodegradable. Other materials like formed metal sheet or some types of molded paper, if properly configured, can also be used.

The encasement can be configured so that it can serve as a protective holder for the product if the manufacturer uses it as the primary device to send or otherwise supply the product by mail or at the point of sale. They might seal the product with a thin plastic label. When the user receives the sealed encasement, they could peel off the plastic label covering the product and insert it in the modular unit. There are other methods by which these encasements can be delivered to the user. They could be packaged in a small standard box or supplied from behind a store counter at a retail location.

The present disclosure offers a solution to provide an environmentally friendly, usable, and modular device for storing a product. The objective is to be able to configure a device that can offer the flexibility of a modular device that is refillable, can be constructed primarily of environmentally sustainable materials with low tolerance materials and, is easy for a user to use.

FIG. 1 shows a perspective view of a COVER 200 and a BASE 100 layers of an exemplary device. Each layer of the configuration includes two key components, i.e., an encasement or cover holder, and a dock. In this drawing is shown a COVER DOCK 261 and a BASE DOCK 161, and a COVER HOLDER 201 and an encasement 101 containing a COMPARTMENT (e.g., a WELL) 190. The cover 200 and base 100 are illustrated in assembled form. The refills and holders serve to connect one layer to the next and contain a method of moving one layer relative to another by means of a rotation or sliding motion. The refills are generally removable from the dock as will be shown later. Components such as the cover holder 201 can be removed from their respective docks 261 depending on their function. In this case the cover holder 201 contains only a mirror 290 and it is not necessary to remove it from the cover. For convenience, the compartment 190 will be described as a well, but it is intended that compartments other than wells are within the scope of the present disclosure. Accordingly, any description using the term "well" shall also be treated as a description using the term "compartment." Additionally, the shapes of the cover dock 261, base dock 161, cover holder 201, and encasement 101, shown in FIG. 1 or in any of the figures are merely examples. Such components may have shapes other than the shapes illustrated in the figures. In any case, cover docks 261 and cover holders 201 are couplable and uncouplable from each other, and base docks 161 and encasements 101 are couplable and uncouplable from each other.

An UPPER CONNECTION 120 located on the encasement 101 can connect to the COVER LOCK ORIFICE (not shown) located on the cover holder 201.

Figure 3:
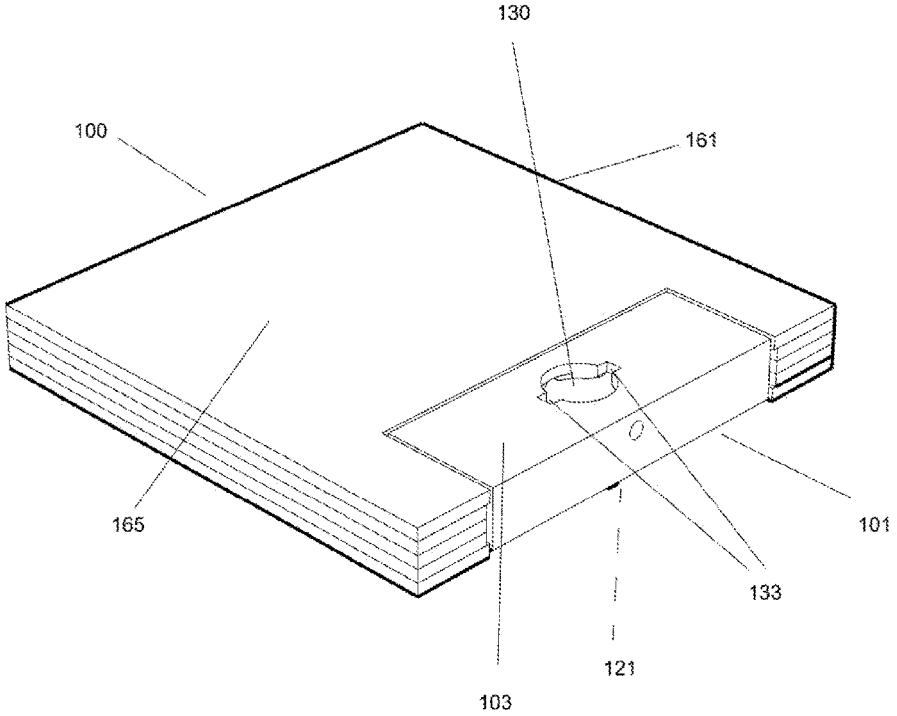
FIG. 3 shows a bottom perspective view of the key features of a base layer with a lock and key configuration.

Two base layers can also connect. The encasement 101 of the base 100 can also contain a similarly configured LOCK ORIFICE 130 (FIG. 3). The lock orifice 130 is an example of an opening configured to engage with a connector. The upper connector 120 engages with both types of orifices in a similar fashion and, this will be described later.

The cover holders and encasement components generally, though not necessarily, can be made of a tight tolerance material since the connector needs to engage with the orifice in the next layer. Their connection devices will be in the form of a tight-fitted connecting structure such as a swivel, latch, or hinge.

Figure 2:
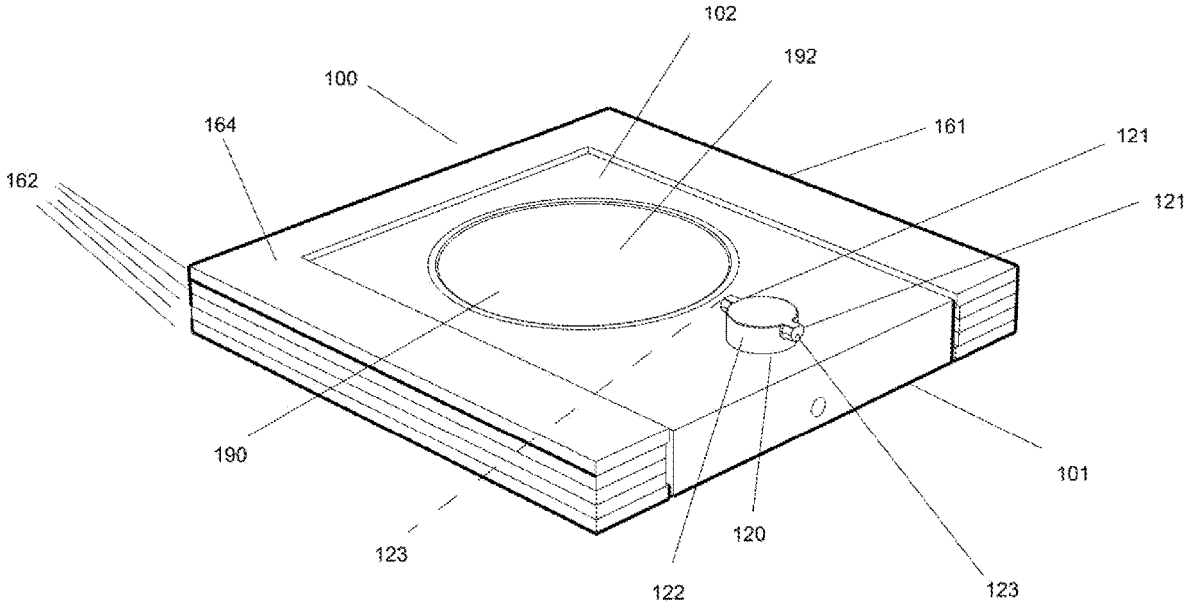
FIG. 2 shows a top perspective view of the key features of a base layer with a lock and key configuration.

FIG. 2 shows a top perspective view of a base 100 layer with the lock configuration. The two main components are the base dock 161 and the encasement 101. In the exemplary device, the base dock 161 is constructed with a set of DOCK SHEETS 162, the top sheet being the DOCK TOP SURFACE 164. Each sheet is made of cardboard, plastic, or some other material that can be glued together as a stack, one piece on top of the next. The sheets are cut into specified shapes which, when stacked together form a structure with a plurality of dock platforms into which the encasement 101 can be securely inserted. The sheets can be cut with a knife, or by a laser or a steel-ruled die cutting operation. These manufacturing operations generally have relatively low dimensional tolerances. Alternatively, the dock 161 can be constructed with wood, glass, or some other suitable material. The dock component may be manufactured with high-cost materials, or materials that are not environmentally friendly. One feature of this configuration is that the dock is intended to be reused. The structure of the dock 161 may be formed by a plurality of dock sheets 162, as described above, or by other processes such as injection molding or wood carving, among others. The resulting structure of the dock has a plurality of platforms of various sizes and shapes, which will be described below herein.

Inserted into the dock 161 and engaging with the structural features formed by the dock sheets is an encasement 101 containing a well 190, into which PRODUCT 192 is filled. On the ENCASEMENT UPPER OUTSIDE SURFACE 102, is an upper connector 120. The upper connector 120 includes three parts—the LOCK COLUMN 122, one or more LOCK PEGs 121, and one or more LOCK NIBs 123. The exemplary configuration shows an encasement 101 that is made of a material that allows a tight dimensional tolerance. The material could be a molded plastic or formed metal such as aluminum.

FIG. 3 shows a bottom perspective view of the base 100 layer with the lock configuration. There is a base dock 161, formed of multiple dock sheets 162 (FIG. 2). The bottom most sheet forms the DOCK BOTTOM SURFACE 165. The encasement 101 is inserted into the dock 161. The ENCASEMENT LOWER OUTSIDE SURFACE 103 contains a LOCK ORIFICE 130 molded through the surface. The dimensions and shape of this orifice 130 allows the upper connector 120 shown in FIG. 2 to be inserted into and engage with the features to be discussed below. Specifically, the orifice 130 has one or more LOCK SLOTs 133 conforming to the shape and dimensions of the lock peg(s) 121. The cover lock orifice from FIG. 1 is similarly configured to engage with the lock peg.

Figure 4:
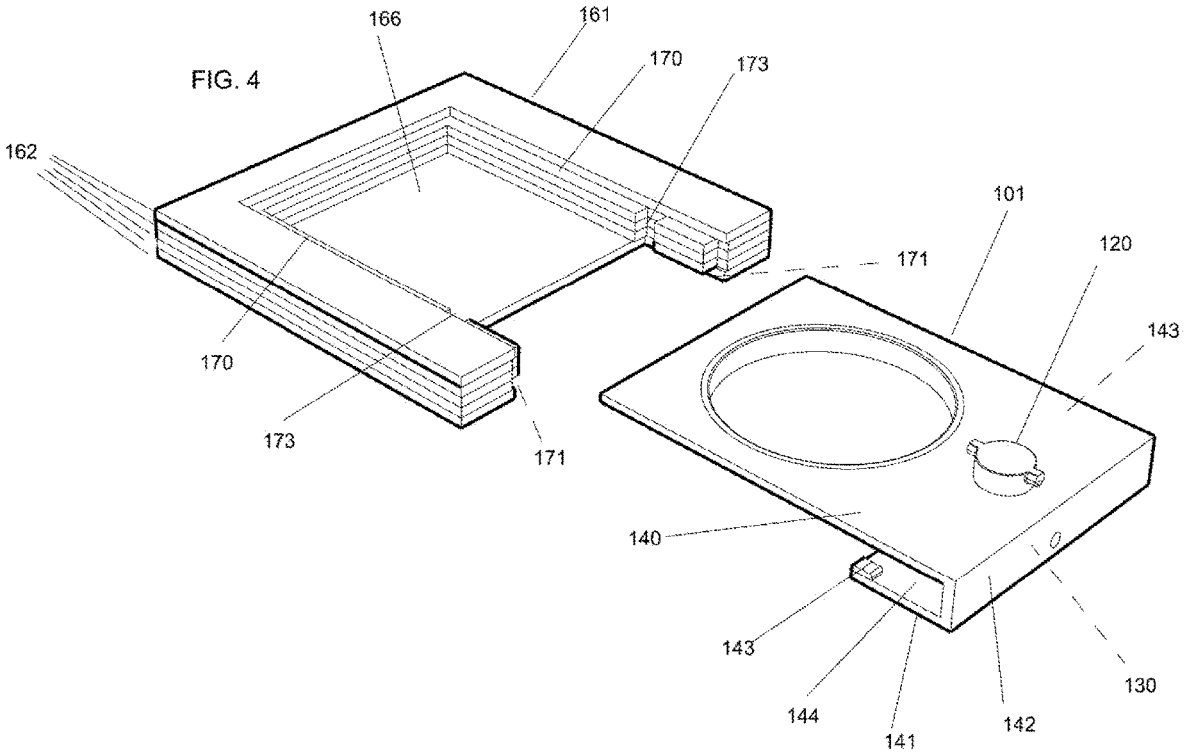
FIG. 4 shows a top perspective view of the encasement component separate from the base dock component.

FIG. 4 shows a top perspective view of the encasement 101 separating from the base dock 161. This operation will be discussed in detail below. The components of FIG. 4 will be described in conjunction with FIG. 5.

Figure 5:
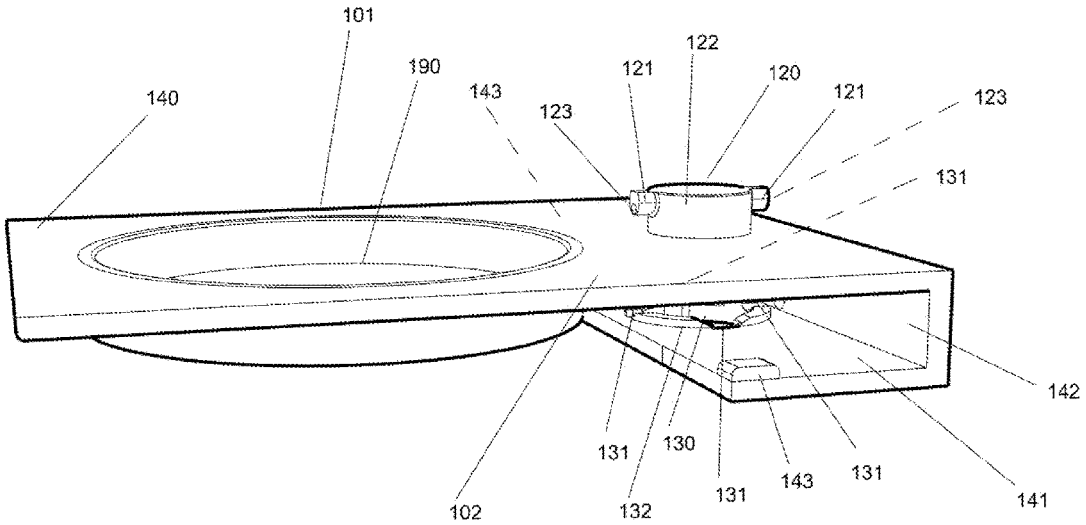
FIG. 5 shows a detailed view of the encasement component.

FIG. 5 shows a detailed view of the encasement 101 component of FIG. 1. Embedded into the ENCASEMENT UPPER PLATFORM 140 is a well 190 which can hold a product. On one side of the encasement upper outer surface 102 is an upper connector 120 that includes a lock column 122, from which extend a pair of lock pegs 121 separated from each other by an angle of about 180 degrees. At each end of the lock peg is a nib 123. There is an encasement lower platform 141 through which is positioned a lock orifice 130. Around the perimeter of the lock orifice is a LOCK LEDGE 132, into which are cut four LOCK RECEIVERs 131. In the exemplary configuration, there are two lock slots 133 (FIG. 3) separated by an angle of 180 degrees, that are positioned just below two of the lock receivers 131.

Connecting the encasement upper and lower platforms is an encasement SIDE WALL 142. Also molded into the encasement lower platform are a pair of ENCASEMENT STAYS 143 to be described below.

The lock column 122 is positioned coaxial to the center of the lock orifice 130. The pair of lock pegs 121 are positioned above two of the lock receivers 131 and pointing in directions that are 90 degrees from the directions of the lock slots 133.

The upper connector is positioned such that when a second base encasement is positioned above the first base encasement such that the second base lock orifice is directly above the first base upper connector, and the lock pegs of the first base encasement are at right angles to the lock slots of the second base refill, the upper connector of the first base can protrude through the lock orifice of the second base. The nibs of the first base upper connector will barely fit through the lock slot of the second base, thus acting as a tight fit snap that will prevent the connector from easily falling out through the orifice after insertion. The base encasement will be made of a material that would allow some flexibility but would be suitable enough to allow the for tolerances to build such a configuration. Polypropylene would be an example of such a material.

The height of the lock pegs 121 above the encasement upper outside surface 102 will be such that it is able to tightly ride the orifice's lock ledge after it is inserted through the lock orifice. As shown below, when the second base encasement is rotated 90 degrees relative to the first base refill, the pegs are also dimensioned to fall into the pair of lock receivers. The tight fit of the lock pegs as they ride along the lock ledge, and the subsequent relaxation of the same lock pegs as they fall into the lock receivers are due to the flexible characteristic of the base refill's material.

Figure 6:
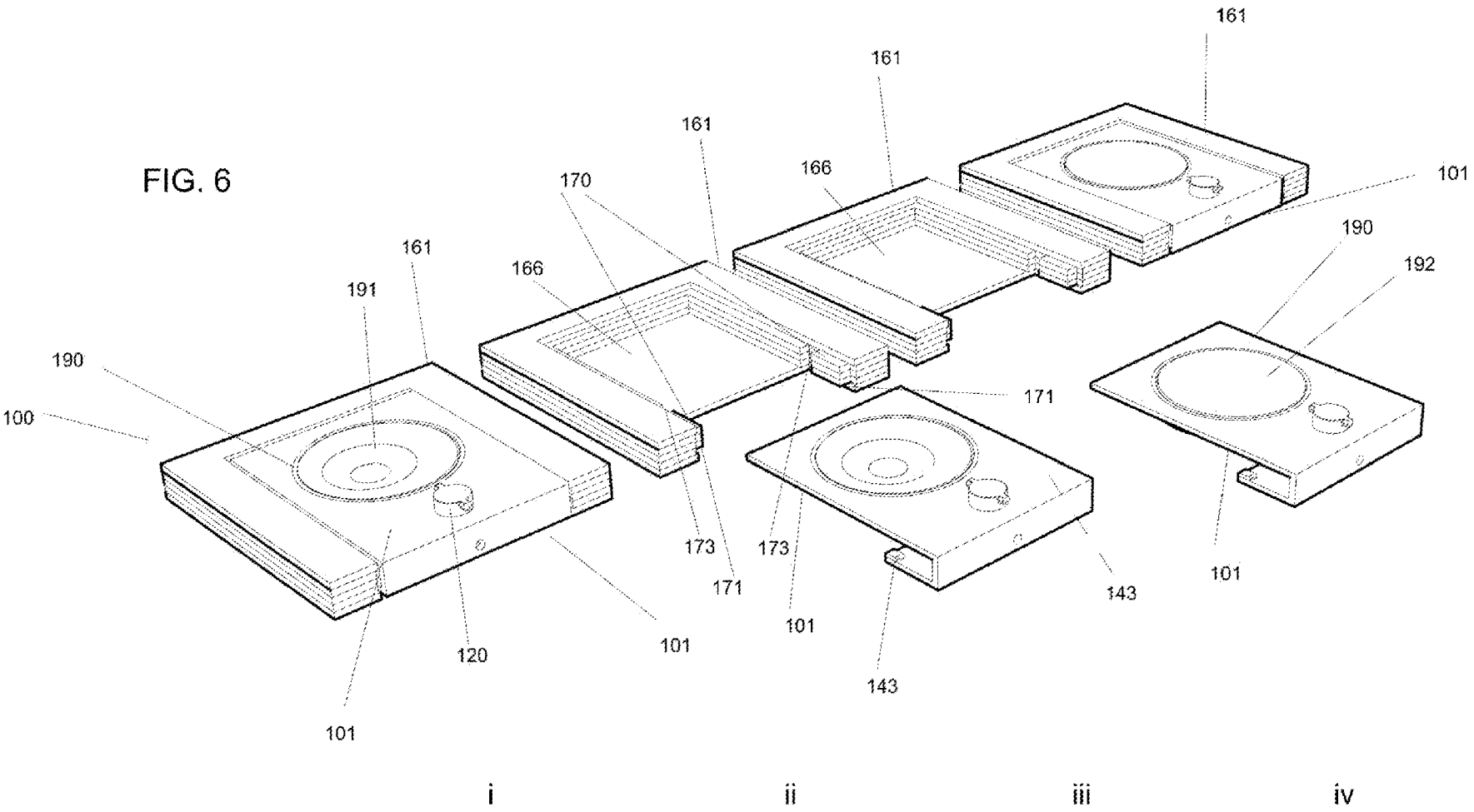
FIG. 6 shows the sequence of a spent encasement removed from the base dock and replaced with a new refill.

FIG. 6 shows the sequence i-iv of a spent base encasement 101 removed from the base dock 161 and replaced with a new refill. In the first frame of the sequence i, the well 190 contains a DEPLETED PRODUCT 191. In ii, the base encasement 101 is removed from the base dock 161. In frame iii, a new base encasement 101 containing product 192 is introduced and, in frame iv, it is inserted into the base dock 161.

Figure 7:
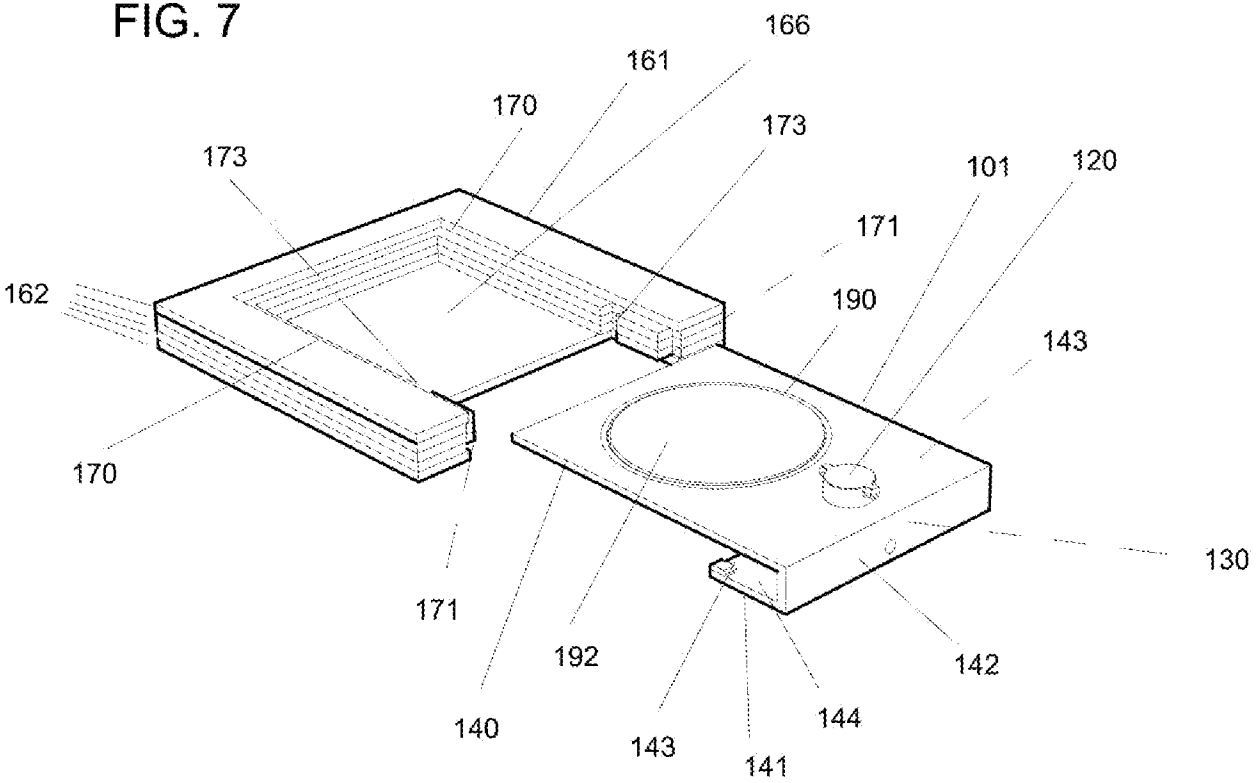
FIG. 7 shows one embodiment detailing how a base encasement interacts with a base dock.

FIG. 7 shows a top perspective view of the encasement 101, with a well 190 containing product 192, separating from the base dock 161. The drawing shows the exemplary base dock 161 with a DOCK SPACE 166 into which the encasement 101 is inserted. Specifically, when the encasement 101 is inserted into the dock 161, the encasement upper platform 140 is slid along the DOCK UPPER PLATFORM 170. The ENCASEMENT LOWER PLATFORM 141 is slid along the DOCK LOWER PLATFORM 171. The exemplary configuration shows a pair of ENCASEMENT STAYS 143 molded onto the ENCASEMENT LOWER INSIDE SURFACE 144, which engage with a pair of DOCK STAYs 173 cut into several of the dock sheets 162. After insertion, the encasement 101 is securely held by base dock 161.

Figure 8:
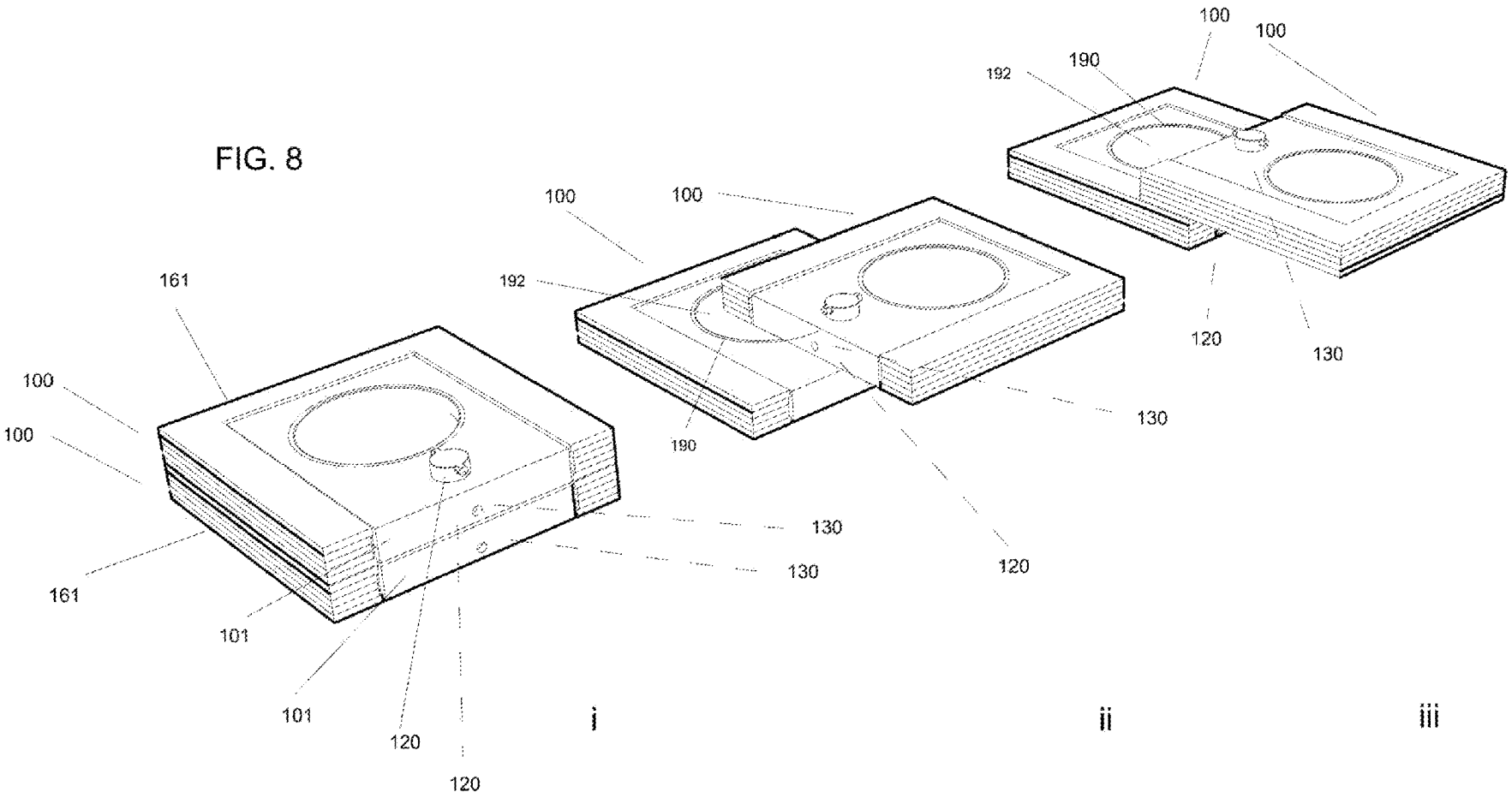
FIG. 8 shows a sequence describing how one base layer of the lock configuration of the connector rotates open relative to a second layer.

FIG. 8 shows a sequence describing how a first (upper) base 100 layer of the lock configuration of the connector rotates open relative to a second (lower) layer. In various embodiments, the first (upper) base layer and the second (lower) base layer may be substantially identical. As mentioned above, the term "substantially identical" means and that devices or components are made to the same specifications but may be slightly dimensionally different due to manufacturing imperfections or limitations, among other factors. The first base layer and the second layer are both labeled as 100 to indicate that they are identical to each other. All of the frames show the base layers in an assembled state. Frame i shows two base layers fully stacked one directly above the other, in an alignment in the same orientation. The upper connector 120 located on what is referred to here as the second (lower) base and the lock orifice 130 located on what is referred to here at the first (upper) base are coaxially aligned, and the upper connector of the second (lower) base is inserted into the orifice of the first (upper) base. Frame ii shows the first (upper) base rotated relative to the second (lower) base layer, around the axes of the lock connectors 120 and lock orifices 130, such that they are in an alignment in different orientations. Frame iii shows the first (upper) base rotated 180 degrees and exposing the product 192 in the second (lower) base, such that they are in an alignment in different orientations.

Figure 9:
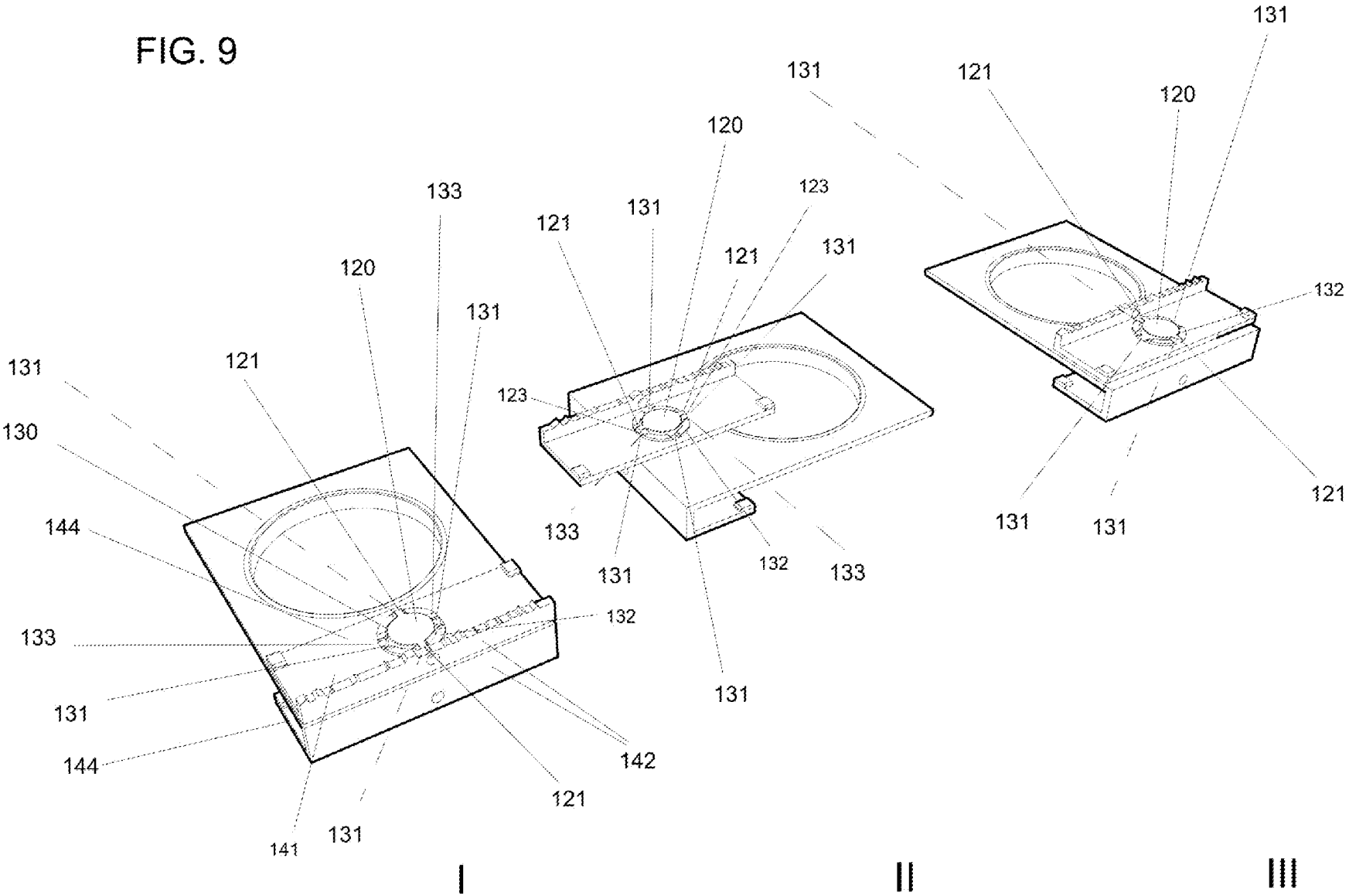
FIG. 9 shows a partial cross-sectional detail focusing on the encasement component, of the same sequence as in FIG. 8.

FIG. 9 shows a cross-sectional detail focusing on the encasement component, of the same sequence as in FIG. 8. The first (upper) base encasement 100 on top is cut away to expose the upper connector 120 of the second (lower) base and the lock orifice 130 of the first (upper) base. In frame i, the first and second encasement bases are aligned. The lock pegs 121 of the second (lower) base encasement are engaged with two of the lock receivers 131 of the upper cut away first base refill, and directionally set 90 degrees from the lock slots 133 of the first (upper) base. Therefore, the lock pegs 121 are locked to the first (upper) bases' encasement lower platform 141. Also, as the lock received are at a lower level from the surrounding lock ledge 132, the first base encasement cannot rotate without sufficient force to overcome the different level heights. Frame ii shows the first (upper) base rotated relative to the second (lower) base layer, around the axes of the lock connectors 120 and lock orifices 130. The rotation occurred after the user provided sufficient force to allow the lock pegs 121 to overcome the height difference with the lock ledge 132. The lock pegs 121 of the second (lower) base have now fallen into a second pair of lock receivers 131 but, because of the nibs 123 located at the end of the lock pegs 121, the upper connector of the second (lower) base encasement is prevented from going through the lock orifice of the first (upper) base refill. Frame iii shows the first (upper) base rotated 180 degrees and exposing the product 192 in the second (lower) base. Again, the rotation was able to continue after the user provided sufficient force to allow the lock pegs 121 to overcome the height difference with the lock ledge 132. The lock pegs 121 of the second (lower) base encasement have again fallen into the second set of lock receivers 131 in the first (upper) base refill. The product 192 of the second (lower) base encasement is now available for use.

Figure 10:
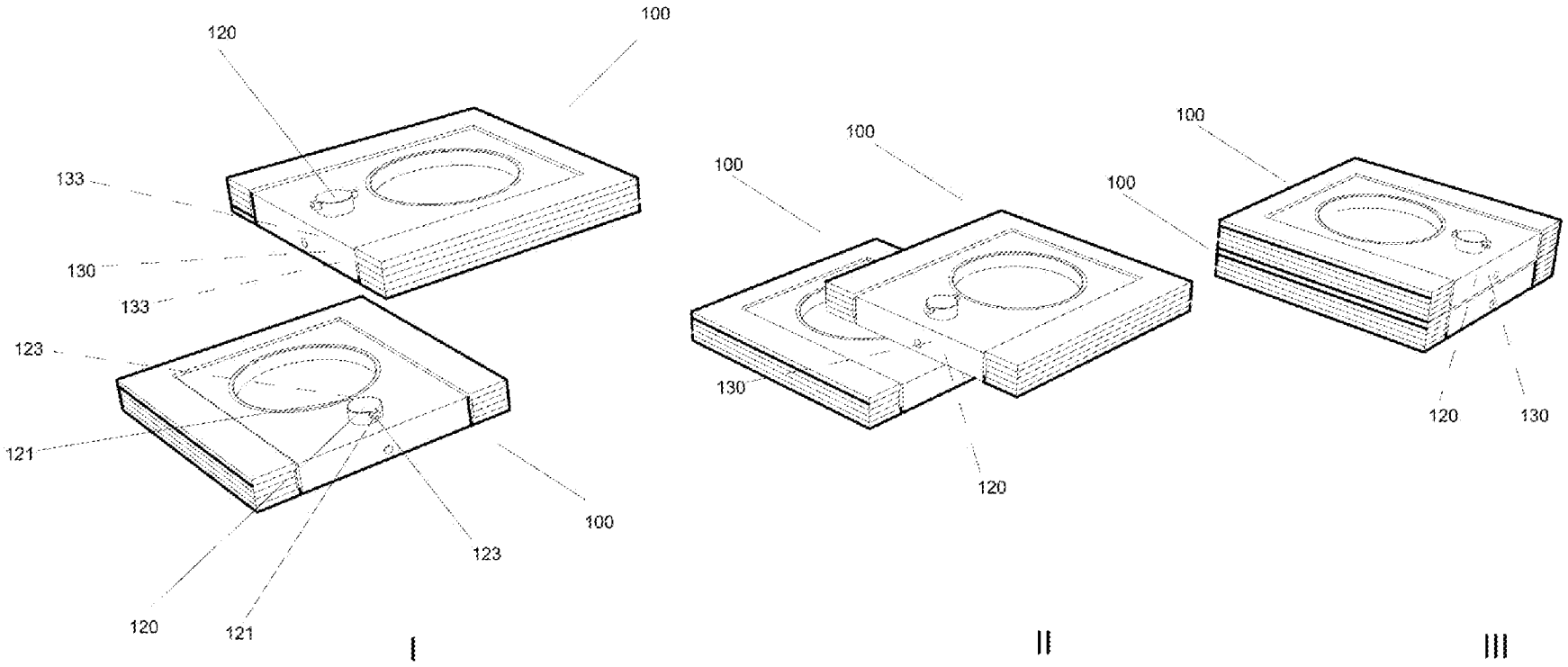
FIG. 10 shows a sequence describing how one base layer of the lock configuration of the connector separates from a second layer.

FIG. 10 shows a sequence describing how one base layer 100 of the exemplary configuration separates from a second layer. As mentioned previously, the upper connector serves two purposes. It allows relative rotation of the two bases, and it connects one base to the next base, or to a cover. Frame i shows a first base separated from a second base. Frame ii shows the first base snapped into position over the second base. For this to be accomplished, the first base must rotate 90 degrees relative to the second base. The upper connector of the second base encasement is then pulled through the lock orifice of the first base refill. Frame iii shows the two bases again aligned and locked together.

Figure 11:
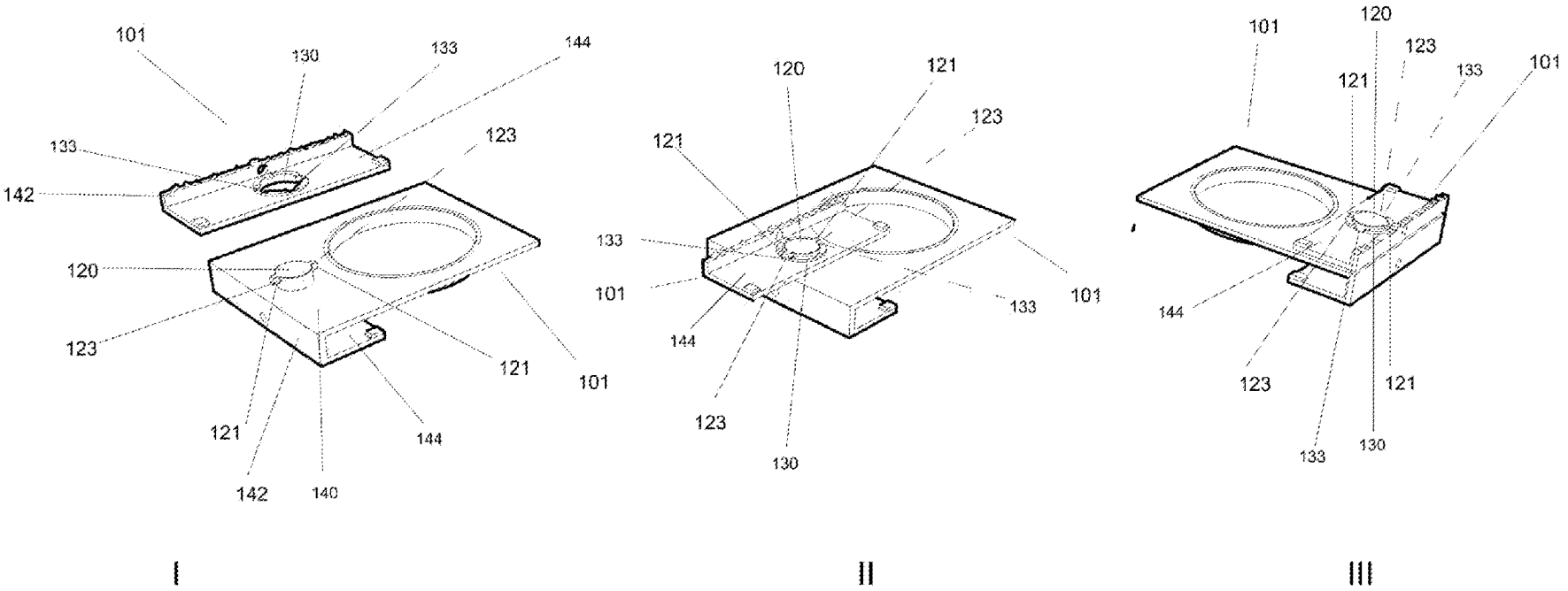
FIG. 11 shows a partial cross-sectional detail focusing on the action of the encasement component, of the same sequence as in FIG. 10.

FIG. 11 shows a cross-sectional detail focusing on the encasement component, of the same sequence as in FIG. 10. The first (upper) base encasement 100 on top is cut away to expose the upper connector 120 of the second (lower) base and the lock orifice 130 of the first (upper) base. As mentioned above, the orientation of the lock slots 133 of the first (upper) base are 90 degrees offset from the orientation of the lock pegs 121 of the second (lower) base below. Frame i shows this orientation with the first (upper) base encasement above the second base (lower) refill. Frame ii shows how the lock pegs 121 have now protruded through the lock slots 133 of the first (upper) base refill. The nibs 123 located at each end of the lock pegs 121 require the user to use force in order to snap the two base refills together. Frame iii shows the first (upper) base rotated 90 degrees to a position where the two base refills are securely fastened to one another and the lock pegs 121 cannot move through the lock slots 133.

FIGS. 12*a-b* shows the closed and open positions of a cover 200 that stores an accessory such as a brush or other product applicator. FIG. 12*a* shows a cover 200 with a COVER DOCK 261 and a COVER COMPARTMENT 201. In this case, the cover compartment 201 has a MIRROR 290. FIG. 12*b* shows the cover compartment 201 after it has slid open in a fashion similar to that described in FIG. 7. When the cover compartment 201 is slid away from the cover dock 261, the COMPARTMENT UPPER PLATFORM 240 is slid along the COVER DOCK UPPER PLATFORM 270. The COMPARTMENT LOWER PLATFORM 241 is slid along the COVER DOCK LOWER PLATFORM 271. Within the COVER DOCK SPACE 266 is placed an ACCESSORY 291.

FIGS. 13*a-b* shows top and bottom views of the relevant parts of a post connector configuration of the present disclosure. The concept is similar in function to the lock configuration except that in lieu of an orifice built into an encasement lower platform, the upper connector extends downwards to present an orifice into which a connector can be inserted. FIG. 13*a* shows the POST BASE 300 with a removable POST ENCASEMENT 301 and POST DOCK 361. On top of the POST ENCASEMENT UPPER PLATFORM 340 is a POST CONNECTOR 320, which includes a POST COLUMN 322 extending from a POST UPPER OUTSIDE SURFACE 302. FIG. 13*b* shows the bottom view of the post base 300. There is a POST INSIDE CONNECTOR 343, that is positioned to be coaxial to the post connector 320. The entrance to the post inside connector 343 is the POST ORIFICE 330. It is approximately level to the POST DOCK BOTTOM SURFACE 365. The post orifice 330 is an example of an opening configured to engage with a connector.

Figure 14:
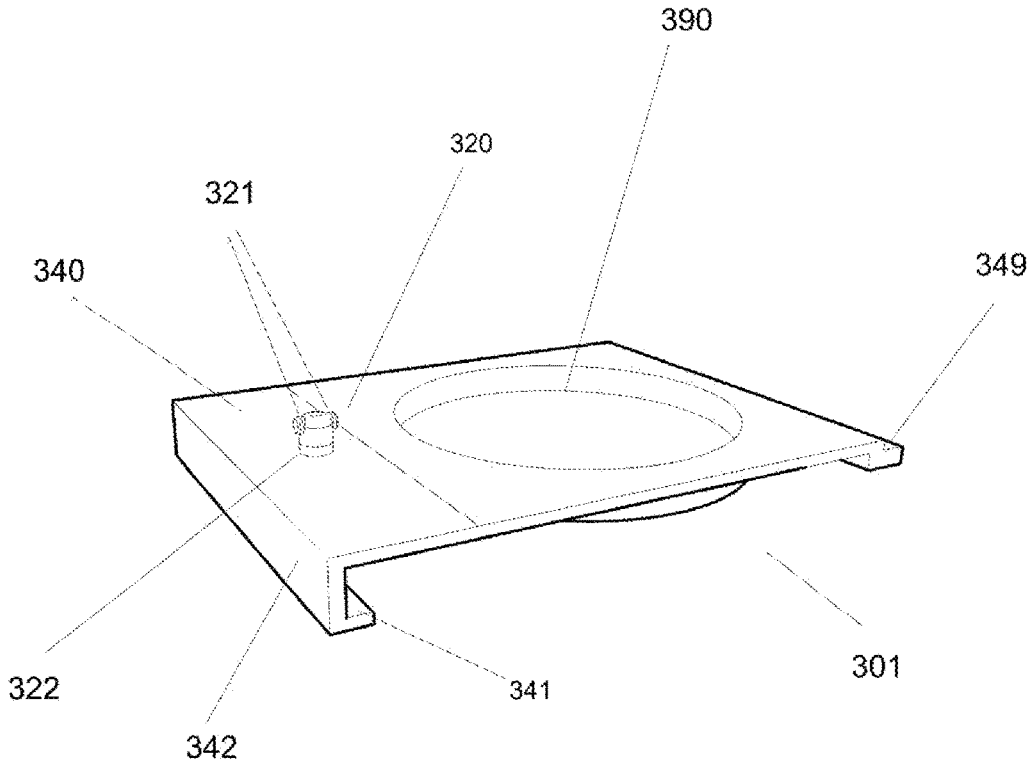
FIG. 14 is a top perspective view that shows detail of the encasement component described in FIGS. 13*a-b*.

FIG. 14 is a top perspective view that shows detail of the post encasement 301 component of the configuration described in FIGS. 13*a-b*. On the post encasement upper platform 340 is the post connector 320 with a post column 322. Extending horizontally from each side and near the top of the column 322 are a pair of POST PEGs 321. A POST ENCASEMENT SIDE WALL 342 extends down from the post encasement upper platform 340 and continues into a POST ENCASEMENT LOWER PLATFORM 341. There is a POST WELL 390 that can contain product. At the end, opposite the post column 322, is a POST ENCASEMENT ANCHOR 349. This helps secure the post encasement 301 into the post dock 361 mentioned in FIGS. 13*a-b*.

Figure 15:
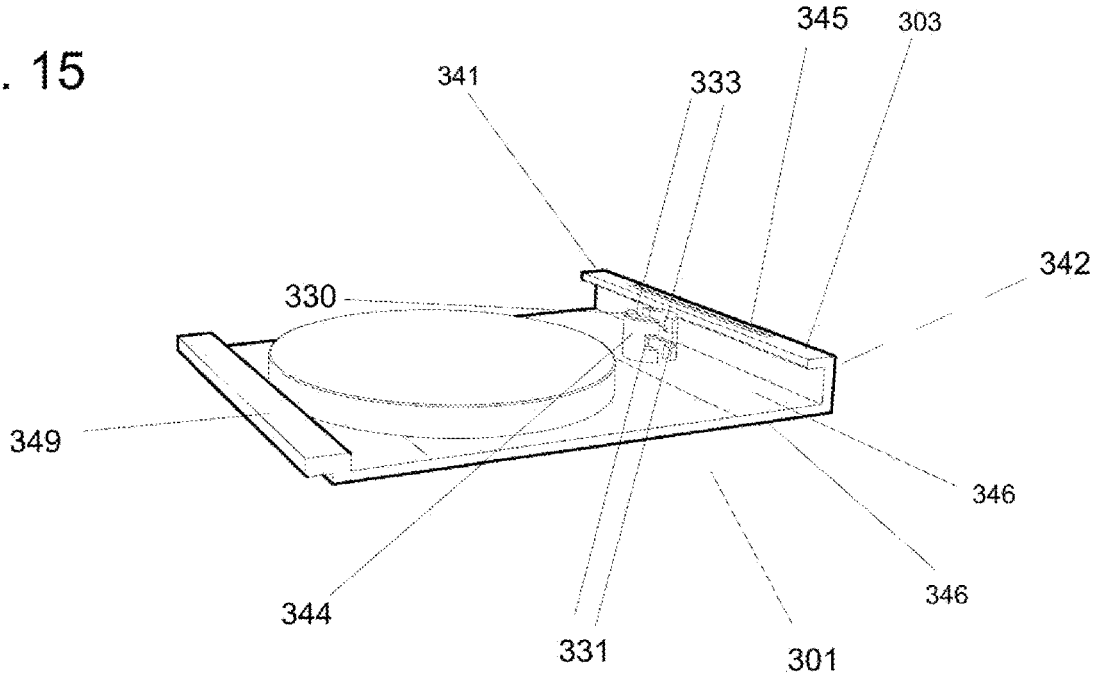
FIG. 15 is a bottom perspective view that shows detail of the encasement component described in FIGS. 13*a-b*.

FIG. 15 is a bottom perspective view that shows detail of the post encasement 301 component of the configuration described in FIGS. 13*a-b*. From the post encasement upper platform 340, on the other side of where the post column 322 is positioned, is a POST INSIDE COLUMN 344, which is hollowed out into the post orifice 330. Cut into the inside perimeter of the post inside column 344 and approximately horizontal to the post encasement upper platform 340 are a pair of POST CHANNELS 331. The distance of these channels 331 from the POST UPPER INSIDE SURFACE 346 is determined to be approximately the same as the distance that the post pegs 321, referred to in FIG. 14, are from the post upper outside surface 302 (FIG. 13). Running parallel to the post inside column 344 are a pair of POST SLOTs 333 conforming to the shape and dimensions of the post peg 321. Within the slots 333 are one or more POST NIBs 323. Cut into the POST LOWER OUTSIDE SURFACE 303, are one or more POST ENCASEMENT NOTCHES 345. These notches 345 assist the user when they pull the post encasement 301 away from the post dock 361.

Figure 16:
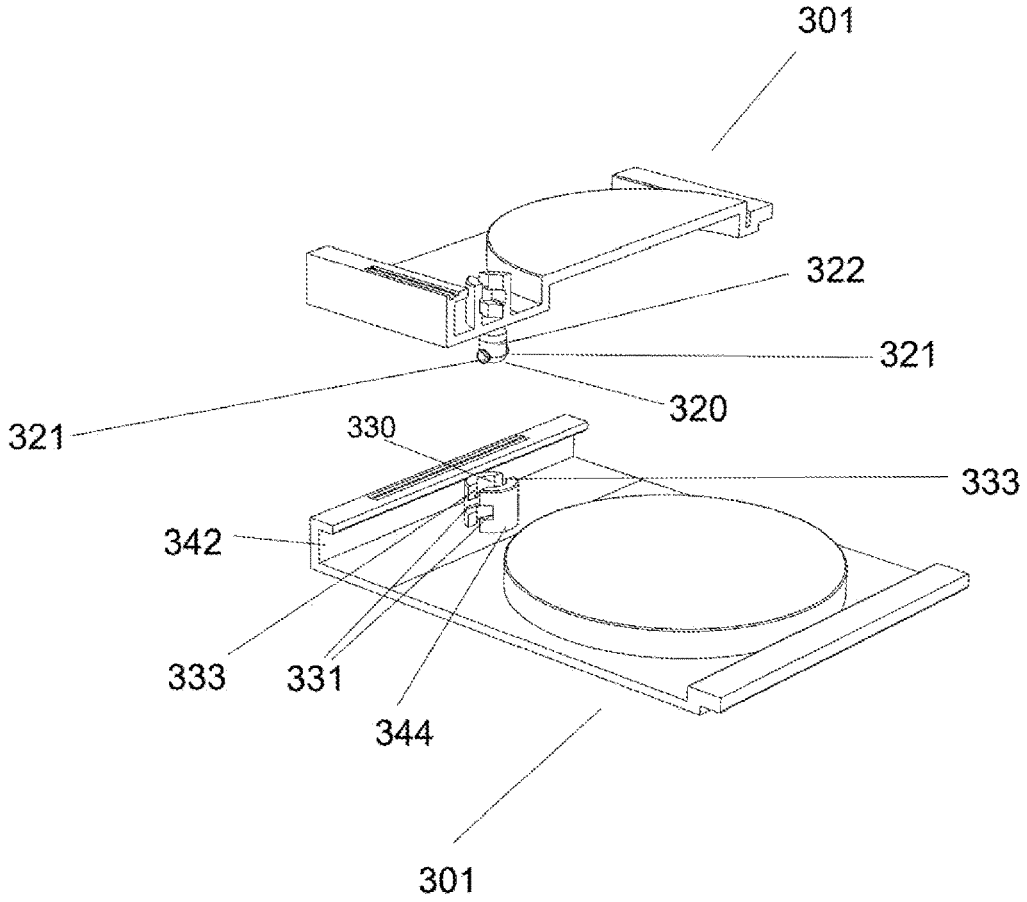
FIG. 16 shows a bottom partial cross-sectioned perspective view of the encasement component that shows detail of one post connector about to lock to a second post connector.

FIG. 16 shows is a bottom partially cross-sectioned perspective view of the encasement post encasement 301 that shows detail of one post connector about to lock to a second post connector. The functions of the components are similar to their counterparts described in FIGS. 9 and 11. Specifically, the functions of the post connector 320, post column 322, post peg 321, post nibs 323, post channel 331, post orifice 330, and post slots 333 are comparable respectively to that of the upper connector 120, lock column 122, lock peg 121, nibs 123, lock ledge 132, and lock slots 133. In order to connect the two post refills, shown from a bottom perspective, the post pegs 321, which are attached to the post column 322 of the second (lower) base, are inserted into the post inside column 344 through the post orifice 330 and post slots 333 of the first (upper) base. When the pegs 321 of the second (lower) post encasement reach the level of the post channels 331 that are embedded in the post inside column 344 of the first (upper) post refill, the first base can be rotated along the post channel until it aligns with the orientation of the second base. The post nibs 323 serve as a method of snapping the two post refills together.

Figure 17:
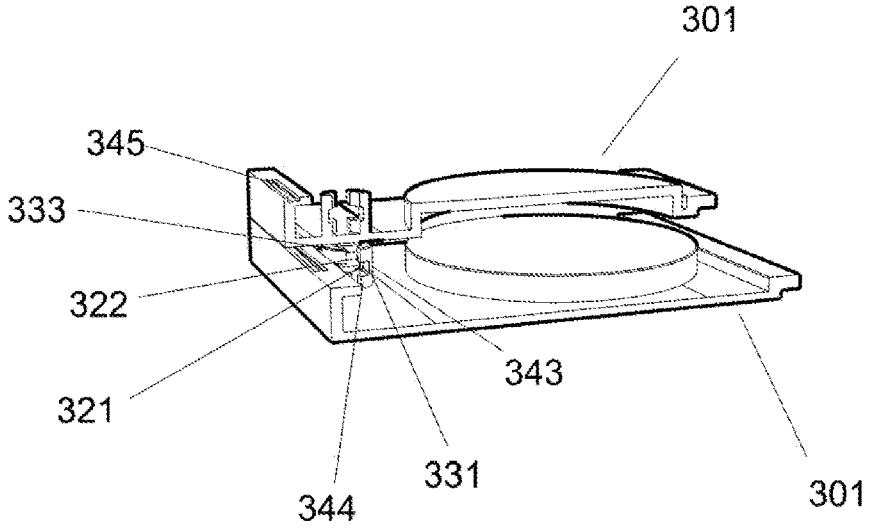
FIG. 17 shows a bottom partial cross-sectioned perspective view of the connectors in FIG. 16 after they have locked together and rotated close.

FIG. 17 details the first and second post encasement 301 sections of the post bases after they are connected. The post connector 320 and inside post connector 343 in FIG. 16 are locked together and rotated closed. The post column 322 has been inserted through the post orifice 330, and the post pegs 321 have engaged with the post channels 331.

FIGS. 18*a-b* shows top and bottom views of another configuration of connecting two device layers via the encasement portion of the present disclosure. FIG. 18*a* shows the top view of a SLIDE BASE 400 which includes a SLIDE ENCASEMENT 401 and a SLIDE DOCK 461. The two portions can separate in a similar fashion as was shown in FIG. 6. A SLIDE LATCH 422 containing a SLIDE NOTCH 421 is attached to the SLIDE UPPER PLATFORM 440 of the slide refill 401. A SLIDE WELL 490 will hold the product.

FIG. 18*b* shows the bottom view. The drawing shows the slide encasement 401 with a SLIDE LOWER PLATFORM 441 and SLIDE SIDE WALL 442. Cut into the SLIDE DOCK BOTTOM SURFACE 465 is a SLIDE DOCK OPENING 464, into which can be fit the slide latch 422. A SLIDE DOCK PATH 466 allows the slide latch 422, and therefore the slide base, to move laterally along the slide dock bottom surface 465. The slide path 466 is an example of an opening configured to engage with a connector.

FIG. 19 is a top perspective view that shows further details of the slide encasement 401. The SLIDE LOWER INSIDE SURFACE 445 of the slide lower platform 441 contains a SLIDE STOP 431 which will be used to control the lateral movement of the slide latch 422 when a second slide base is connected.

Figure 20:
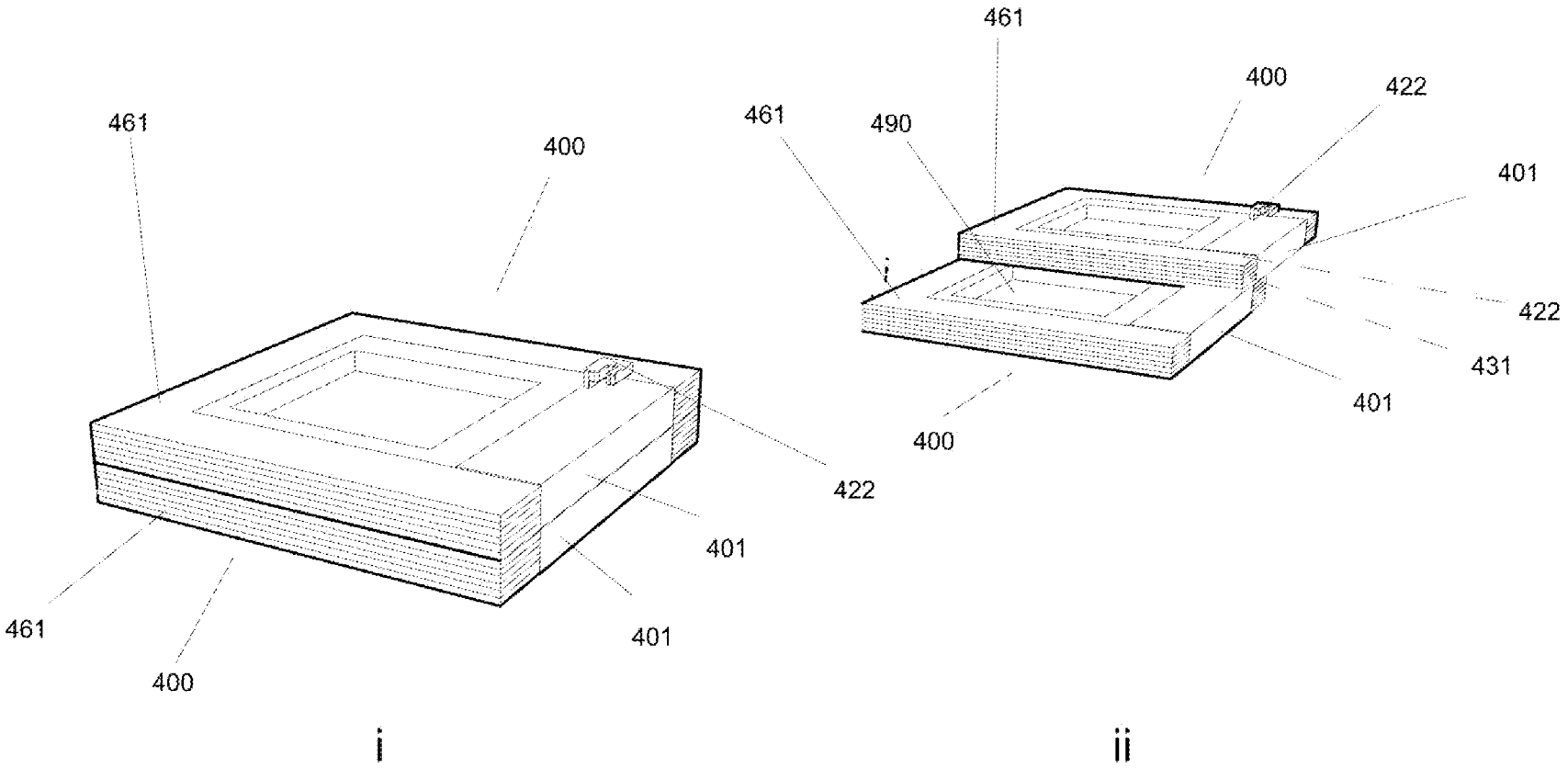
FIG. 20 is a perspective view that shows a sequence describing how one base layer slides relative to a second base.

FIG. 20 shows a sequence describing how a first (upper) slide base 400 slides open relative to a second (lower) layer. Frame i shows two base layers stacked one directly above the other. It will be shown later that the slide latch 422 of the lower slide base is attached to the slide lower inside surface of the upper slide base. The upper and lower slide bases are stacked and positionally aligned. Frame ii shows the first (upper) slide base slid open relative to the second (lower) slide base, exposing the slide well 490 within. The lower slide latch has traversed along the slide dock path 466 shown in FIG. 18*b*.

Figure 21:
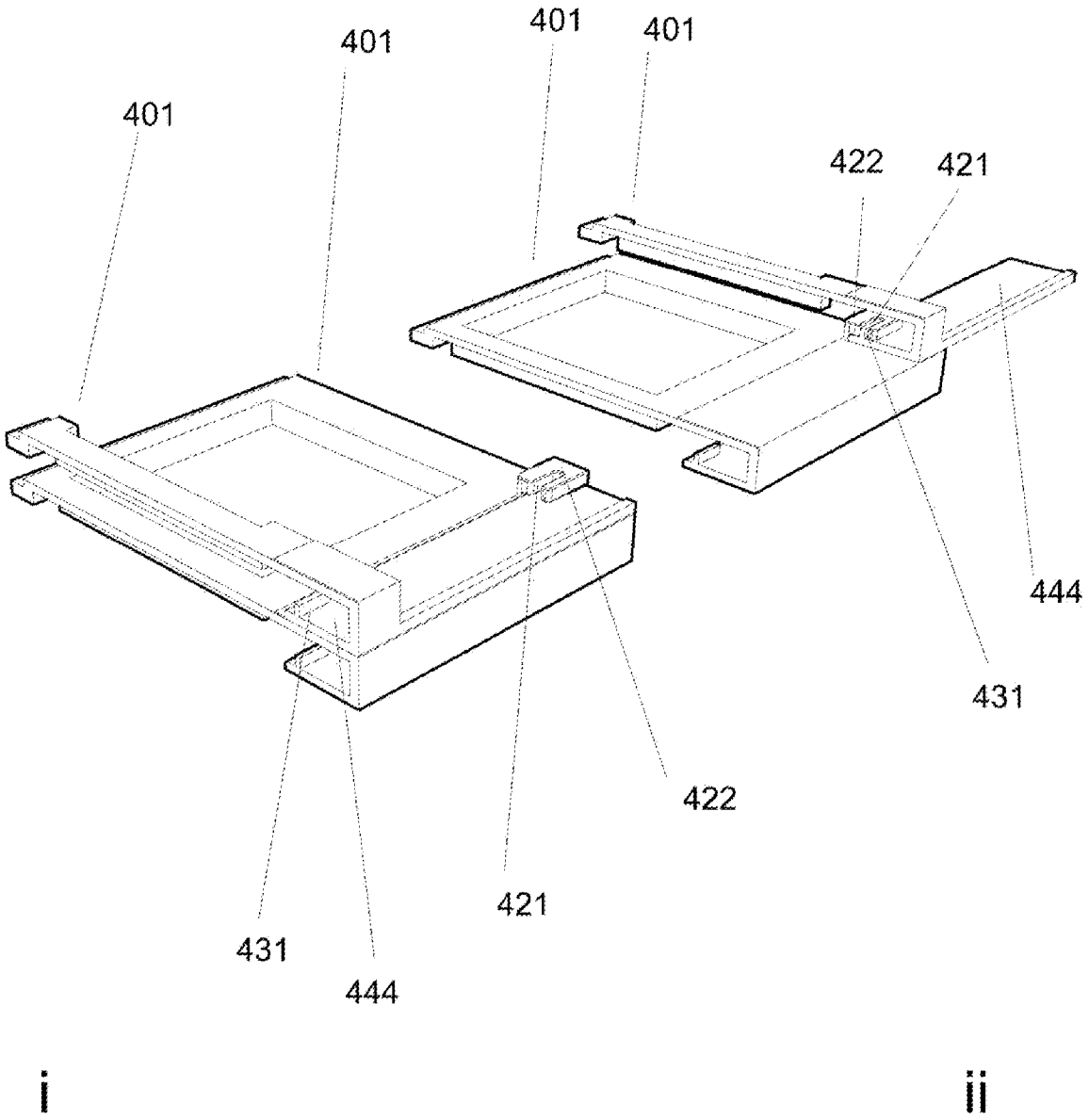
FIG. 21 shows a top partial cross-sectioned perspective view of the encasement component, that shows a sequence depicted in FIG. 20.

FIG. 21 shows a top partially cross-sectioned perspective view of the encasement component portion of the sequence depicted in FIG. 20. The slide latch 422 of the lower slide encasement 401 engages the slide lower inside surface 444 of the upper slide refill. As in FIG. 20, the upper and lower slide refills are stacked and positionally aligned. Frame ii shows the slide encasement of the first (upper) slide base slid open relative to that of the second (lower) slide base. The lower slide latch 422 is engaged with the slide lower inside surface 444 of the upper slide base and slides across the surface until the latch notch 421 engages with the slide stop 431 attached to the lower slide refill.

Figures 22A, 22B:
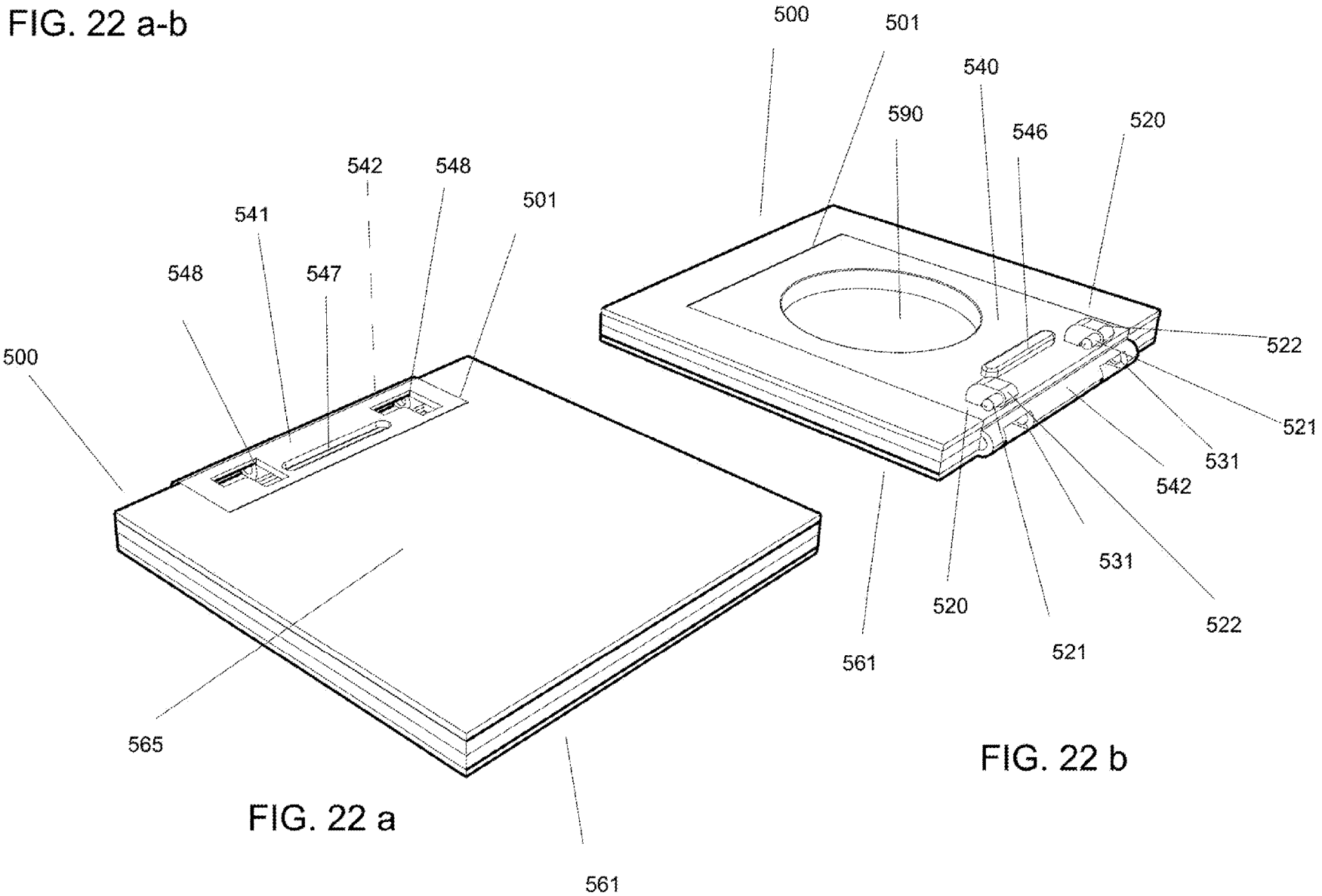
FIGS. 22*a-b* shows top and bottom views of the relevant parts of a pin hinged connector configuration of a disclosed device.

FIGS. 22*a-b* show top and bottom views of another configuration of connecting two device layers via the encasement portions of the present disclosure. In this case two HINGE BASES 500 are connected by one or more PIN HINGE MECHANISMs 520. FIG. 22*a* shows a hinge base 500 that includes a HINGE ENCASEMENT 501 and a HINGE DOCK 561. The hinge encasement 501 and hinge dock 561 can separate in a similar fashion as was shown in FIG. 6.

FIG. 22*b* shows a top view of the hinge encasement 501. The hinge encasement 501 has a pair of HINGE MECHANISMS 520 attached to a HINGE UPPER PLATFORM 540. There are a pair of HINGE ORIFICEs 548 (FIG. 22*a*) that penetrate through a HINGE LOWER PLATFORM 541. The hinge orifices 548 are an example of an opening configured to engage with a connector. The hinge lower and upper platforms are connected by a HINGE SIDE WALL 542.

Embedded within the hinge side wall is a HINGE PIN HOLE 531 that, in the exemplary configuration, extends through its length. The hinge mechanisms 520 and the hinge orifices 548 are positioned such that when two hinge bases 500 are stacked together, the hinge mechanisms 520 may be inserted into the orifices 548 and then aligned so one hinge base aligns with the second hinge base. The HINGE DOCK BOTTOM SURFACE 565 is approximately flush with the hinge orifices 548 entranceway.

FIG. 23*a-b* is a perspective view that shows top and bottom detail of the hinge encasement 501 component of the hinge base described in FIGS. 22*a-b*. FIG. 23*a* shows the top view of the hinge refill 501. The pair of hinge mechanisms 520 each include a HINGE COLUMN 522, from which laterally extends a HINGE PIN 521. There is a HINGE PROTRUDING LOCK 546 whose function will be discussed below. FIG. 23*b* shows the bottom view of the hinge refill 501. As was mentioned, the hinge pin hole 531 runs continuously through the hinge side wall 542. The hinge pin hole 531 and the hinge pin 521 are positioned so that when two hinge bases are stacked as was discussed in FIG. 22*b*, the hinge pins 521 are completely inserted into the hinge pin hole 531 that is embedded in the hinge side wall 542.

FIG. 24 shows a sequence describing how a first hinge base 500 layer with the pin hinge rotates open relative to a second hinge base layer. Frame i shows the two hinge base layers closed, with one stacked on the other. Frame ii shows the first (upper) hinge base layer rotated along the common axis of the hinge pins 521 and the hinge pin holes 531. The opened device now exposes the HINGE WELL 590.

Figure 25A:
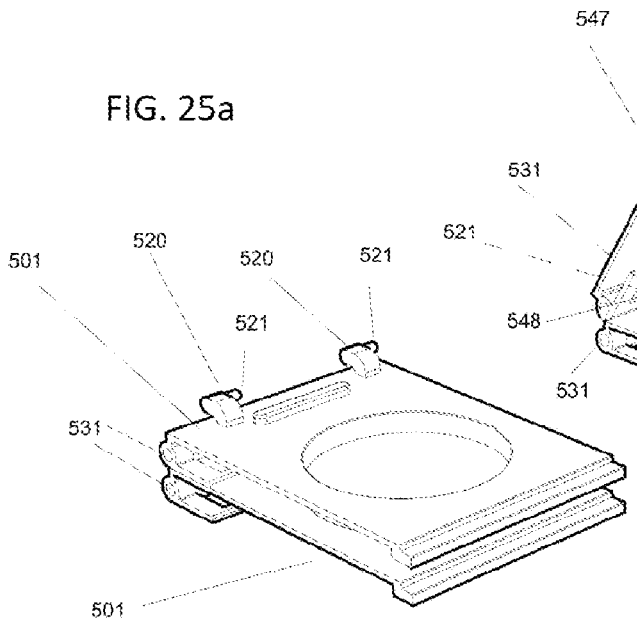
FIGS. 25*a-b* show a sequence of FIG. 24, focusing on the encasement component and describing how one base layer of the pin hinge configuration of the connector rotates open relative to a second layer.
Figure 25B:
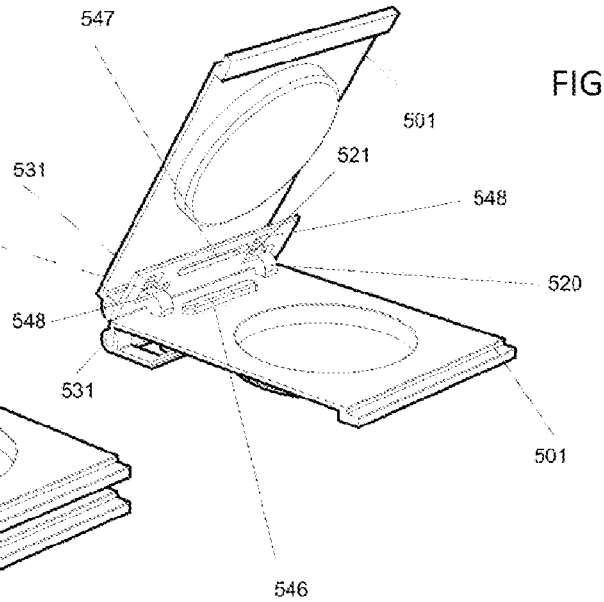

FIGS. 25*a-b* show a sequence of FIG. 24, focusing on the encasement component 501 and describing how one base layer of the pin hinge configuration of the connector rotates open relative to a second layer. FIG. 25*a* is a top perspective view of the first (upper) hinge encasement 501 stacked upon the second (lower) hinge refill. FIG. 25*b* shows the first (upper) hinge encasement rotated upwards relative to the second (lower) hinge refill. The rotation axis is formed from the common axes of the hinge pins 521 and hinge pin holes 531 when the former is inserted into the latter. There is HINGE PROTRUDING LOCK 546 protruding from the hinge upper platform 540 and configured to align with a HINGE UNDERSIDE HOLE 547 penetrating through the hinge lower platform 541. When the first hinge base is closed against the second hinge base, the hinge protruding lock 546 of the second (lower) hinge base will engage with the hinge underside hole 547 of the first (upper) hinge base and assist in securing the two hinge bases together in their closed position. Another way that the two hinged bases, or a hinged base and a cover, can be secured closed is to embed mutually attractive magnetic elements into each of the two bases, or the base and the cover.

It should be noted that in all the configurations mentioned above involving a pair of bases, the first (upper) base may be replaced with a cover containing the necessary configuration features to engage with the second (lower) base. Also, the device may contain multiple base layers and a cover, with each base engaging with a cover or with a base layer immediately above or below it.

Furthermore, it is possible to combine different configurations so that one base or cover may both swivel and slide relative to a second base.

In all cases, the encasement component of a base layer is removable from a docking component. When the encasement and docks are assembled, they can connect to another base or cover that has an encasement or cover holder, respectively, and dock components. The encasement or cover holder connector also can act as a hinging mechanism the opens and closes the device so that a user can access the product.

FIGS. 26*a-b* shows an encasement component with different well configurations. FIG. 26*a* shows an encasement 101 with a DOUBLE WELL 902. FIG. 26*b* shows an encasement 101 with a ROUND WELL 901. The round well 901 and/or the double well 902 may be used in conjunction with any of the encasement configurations disclosed herein.

FIG. 27 shows a base 100 and cover 200 of the present disclosure showing the dock wrapped with PAPER WRAP 910. The paper wrap 910 may be used in conjunction with any of the base and cover configurations disclosed herein.

Figure 28:
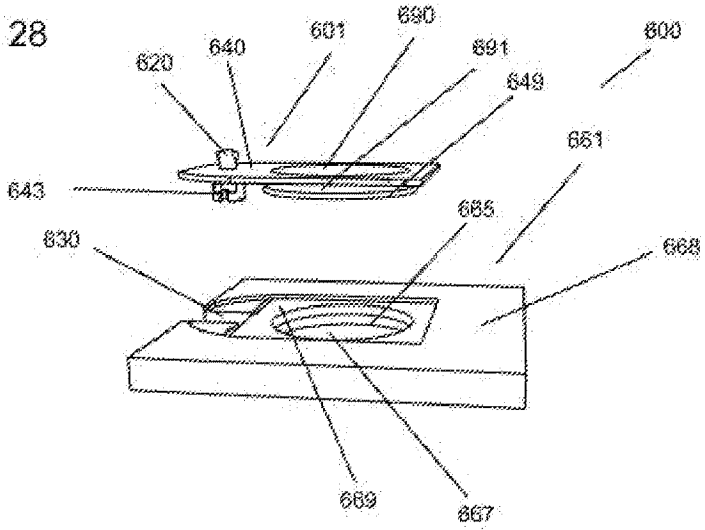
FIG. 28 shows a snap-in configuration of inserting the encasement into the base dock using the post base configuration as an example.

FIG. 28 shows a snap-in configuration of inserting the encasement into the base dock. To demonstrate the snap-in configuration, FIG. 28 shows a post base connector as described in FIGS. 13-17. The snap-in post base 600 includes a snap-in post dock 661 and a snap-in post encasement 601. Cut into the snap-in post dock upper platform 668 is a snap-in post dock second platform 669, in which there is a snap-in post dock hole 667. Surrounding the perimeter of the lower portion of the hole 667 is a snap-in post dock undercut surface 665. On one side of the dock 661 is cut a snap-in post orifice 630. The snap-in post encasement 601 includes a snap-in post well 690 with a snap-in post well outer wall 691 that fits into the snap-in post dock hole 667. At the bottom of the outer wall 691 is a snap-in encasement anchor 649, in this case a protrusion that extends around the perimeter of the lower section of the snap-in post well outer wall 691 and is configured to engage with the snap-in post dock undercut surface 665. When the snap-in post encasement 601 is inserted onto the snap-in post dock second platform 669, the anchor 649 will snap under the snap-in post dock undercut surface 665 and secure the encasement 601 into the dock 661. The snap-in post inside connector 643 simultaneously is inserted into the snap-in post orifice 630 so that another snap-in post base may engage modularly with this first base.

Figure 29:
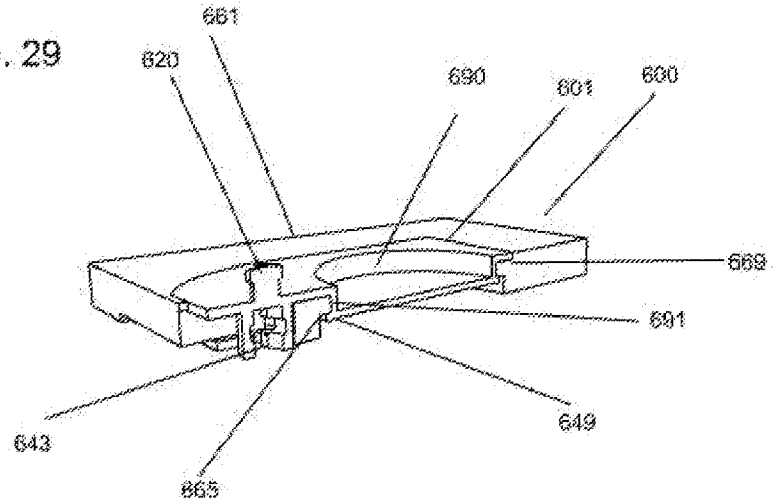
FIG. 29 shows the snap-in configuration as a cross-section with the encasement and dock assembled.

FIG. 29 shows the snap-in configuration as a cross-section with the encasement 601 and dock 661 of FIG. 28 securely held together. The snap-in post encasement anchor 649 is shown engaging with the snap-in post dock undercut surface 665.

There are various other ways and configurations of inserting an encasement into the dock, and such other ways and configurations are contemplated to be within the scope of the present disclosure. For example, encasements can be inserted from the bottom of the dock and snapped in, or they could be screwed in. Furthermore, other types of encasements, including the slide and pin hinge configurations, may also be inserted into the dock by various methods described above. Regardless how they are inserted into the dock, or which encasement configuration is inserted, the encasement is readily removable from the dock to allow them to be interchanged with another, and they are positioned so that they can readily interact with another encasement secured to a second dock.

Figure 30B:
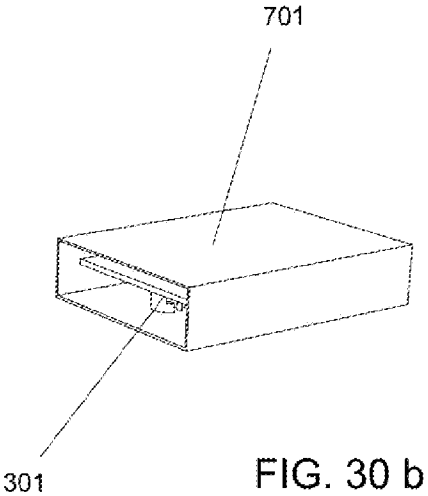
FIGS. 30 *a-b* show how a replacement of the encasement can be packaged and sent to the user.
Figure 30A:
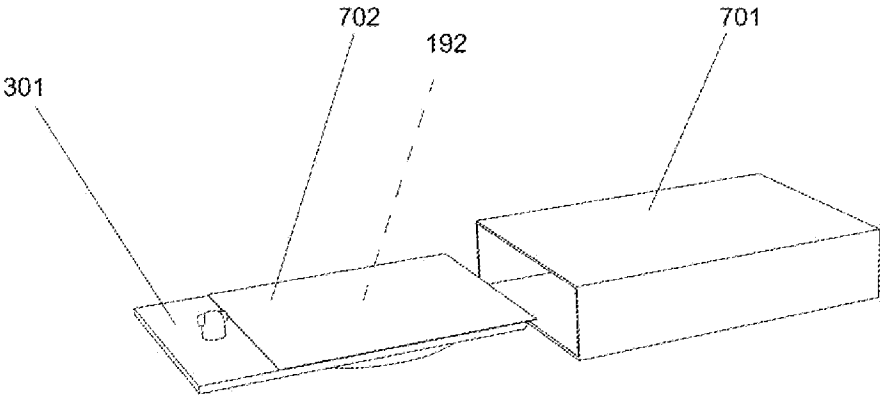

FIG. 30*a* shows how a replacement of an encasement can be packaged and sent to the consumer. In this case, a post encasement 301 is sent to a consumer packaged in a box 701. The product 192 is enclosed within the encasement 301 and covered with a label 702. FIG. 30*b* shows the post encasement 301 packaged within the box 701.

Figure 31:
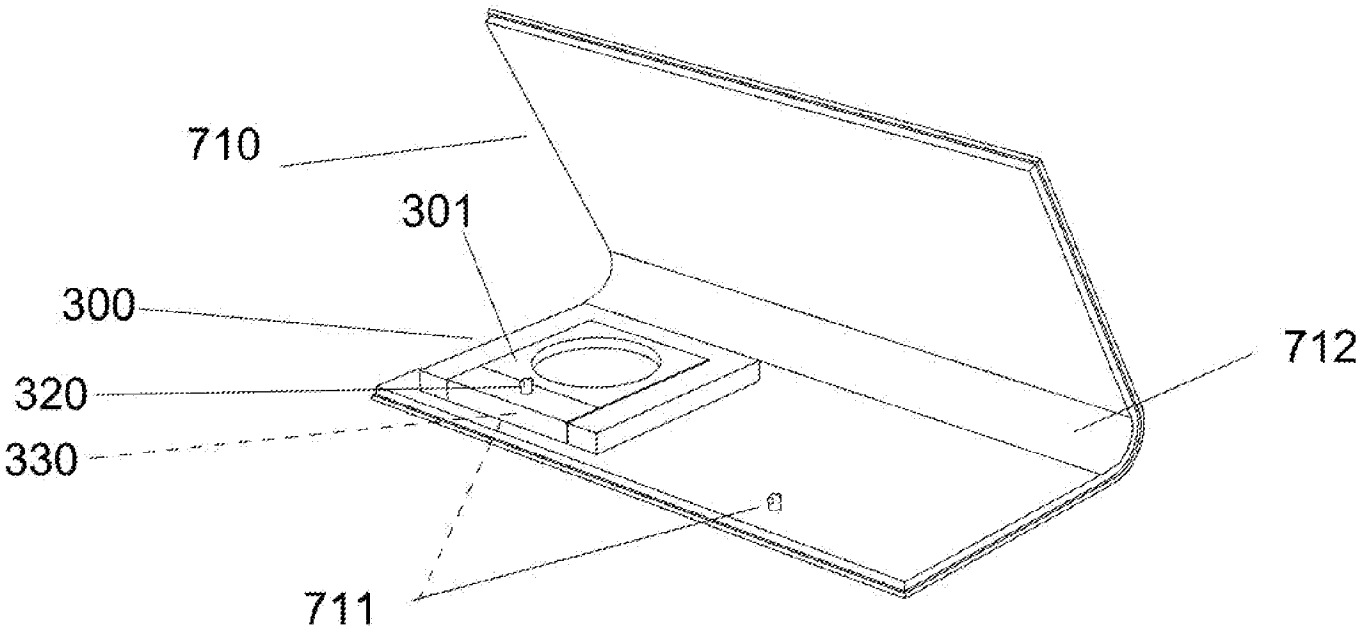
FIG. 31 shows how multiple modular bases can be assembled into a wallet.

FIG. 31 shows that multiple modular bases can be assembled into a wallet. The wallet can be used as a device enclosure in lieu of a device cover 200 (an example of which is shown in FIGS. 12*a-b*) and can house the device bases. In this case a post base 300 is secured within a wallet 710 when a wallet connector 711 engages with the post orifice 330 section of the post base 300. The configuration of the wallet connector 711 is similar to that of the post connector 320 shown in FIG. 14, and it interacts with the post orifice 330 in the same way that is described in FIGS. 16 and 17. The wallet 710 in this case is foldable at the wallet hinge 712.

By the same mechanism as when one post base is connected to a second post base, the base 300 is free to rotate relative to the wallet 710. It is also possible to configure a wallet 710 with other types of connectors—pin hinge and slide connectors, for examples—such that pin hinge and slide bases can also be housed in and moved as described above in this description.

FIGS. 32 *a-c* show various positions of the post base 300 as they are inserted into the wallet 710. FIG. 32*a* shows the wallet 710 in a closed position with four post bases 300—two on one side and two on the other side. The bottom two post bases on either side would be connected to the lower portion of the wallet 710 by the secure contact between the lower post bases' post orifice 330 and the wallet connectors 711, as is show in FIG. 32*b*. A second set of post bases is placed on top of the lower post bases and can be rotated relative to one another. FIG. 32*c* shows that the post bases 300 can be disconnected from the wallet 710, and from each other.

The wallet is one alternative to using a cover on top of a base. Other possible enclosures are contemplated and include boxes, palettes, and purses. Any enclosure which can accommodate one or more bases, allow the bases to rotate or slide such that the product can be exposed, and allow the bases to be disconnected from the enclosure, would serve as suitable alternatives to a cover. Such and other alternatives are contemplated to be within the scope of the present disclosure.

In the description, as mentioned above, a compartment is described using a well, as an example. It is intended that compartments other than wells are within the scope of the present disclosure. Accordingly, any description using the term "well" shall also be treated as a description using the term "compartment."

In various embodiments where multiple modular units are fitted together, the modular units may be substantially identical to each other. As mentioned above, the term "substantially identical" means and that devices or components are made to the same specifications but may be slightly dimensionally different due to manufacturing imperfections or limitations, among other factors. In various embodiments where multiple modular units are fitted together, some or all of the modular units may not be substantially identical and may have different configurations. In any case, modular units are couplable and uncouplable from each other.

In the present disclosure, the shapes of cover docks, base docks, cover holders, and encasements, as illustrated in the figures, are merely examples. Such components may have shapes other than the shapes illustrated in the figures. In any case, cover docks and cover holders are couplable and uncouplable from each other, and base docks and encasements are couplable and uncouplable from each other.

The embodiments disclosed herein are examples of the disclosure and may be embodied in various forms. For instance, although certain embodiments herein are described as separate embodiments, each of the embodiments herein may be combined with one or more of the other embodiments herein. Specific structural and functional details disclosed herein are not to be interpreted as limiting, but as a basis for the claims and as a representative basis for teaching one skilled in the art to variously employ the present disclosure in virtually any appropriately detailed structure. Like reference numerals may refer to similar or identical elements throughout the description of the figures.

The phrases "in an embodiment," "in embodiments," "in various embodiments," "in some embodiments," or "in other embodiments" may each refer to one or more of the same or different embodiments in accordance with the present disclosure. A phrase in the form "A or B" means "(A), (B), or (A and B)." A phrase in the form "at least one of A, B, or C" means "(A); (B); (C); (A and B); (A and C); (B and C); or (A, B, and C)."

It should be understood that the foregoing description is only illustrative of the present disclosure. Various alternatives and modifications can be devised by those skilled in the art without departing from the disclosure. Accordingly, the present disclosure is intended to embrace all such alternatives, modifications, and variations. The embodiments described with reference to the attached drawing figures are presented only to demonstrate certain examples of the disclosure. Other elements, steps, methods, and techniques that are insubstantially different from those described above and/or in the appended claims are also intended to be within the scope of the disclosure.

What is claimed is:

1. A device comprising:

a dock comprising a plurality of dock platforms and a dock space defined by the plurality of dock platforms, wherein the plurality of dock platforms comprises a top platform, a bottom platform, a first intermediate platform defining a dock upper platform, and a second intermediate platform defining a dock lower platform; and an encasement comprising an encasement upper platform, an encasement lower platform, an encasement side wall, at least one compartment configured to hold a product, a connector extending from the encasement upper platform, and an opening, wherein the connector and opening are complementary to each other, wherein the encasement and the dock are couplable to each other into an assembled form and are uncouplable from each other, wherein in the assembled form, the at least one compartment is positioned within the dock space and a periphery of the assembled form is defined by the encasement lower platform, the encasement upper platform, the encasement side wall, and outer portions of the plurality of dock platforms, wherein in the assembled form, the dock and the encasement are coupled to each other by the encasement upper platform abutting the top platform and the dock upper platform, and by the encasement lower platform abutting the bottom platform and the dock lower platform, and wherein in the assembled form, the dock and the encasement are not coupled together by the connector or by the opening.

2. The device of claim 1, wherein in the assembled form, the dock space is bounded on top by the encasement upper platform of the encasement and bounded on bottom by the bottom platform of the dock, such that in the assembled form, the compartment of the encasement is not covered by the dock.

3. The device of claim 1, further comprising a cover configured to be couplable to the dock and uncouplable from the dock, the cover comprising an opening complementary to the connector of the encasement such that the opening of the cover is couplable to the connector of the encasement.

4. The device of claim 1, wherein the encasement is configured to be disposed and the dock is configured to be reused with a new encasement.

5. The device of claim 4, wherein the dock is made from at least one of: paper, wood, or glass.

6. The device of claim 5, wherein the encasement is made from plastic.

7. The device of claim 1, wherein the opening of the encasement is one of:

an orifice formed in the encasement lower platform, an orifice formed by a post inside column extending from the encasement upper platform in a direction opposite from the connector, or a slide path formed by the encasement lower platform.

8. The device of claim 7, wherein the connector of the encasement is one of:

a column with pegs extending from the column, a slide latch, or a hinge column with a hinge pin extending from the hinge column.

9. The device of claim 1, wherein the assembled form of the dock and the encasement form a first base layer, the device further comprising:

a second base layer comprising:

a second dock comprising a second plurality of dock platforms and a second dock space defined by the second plurality of dock platforms, and a second encasement comprising a second encasement upper platform, a second encasement lower platform, a second encasement side wall, at least one second compartment configured to hold a product, a second connector extending from the second encasement upper platform, and a second opening, wherein the second opening is configured to couple with the connector of the encasement of the first base layer and the second connector is configured to couple with the opening of the encasement of the first base layer, wherein the second encasement and the second dock are couplable to and uncouplable from each other, wherein the first base layer and the second base layer are couplable to each other in an assembled state and are uncouplable from each other by:

coupling and uncoupling the connector of the encasement of the first base layer with the second opening of the second encasement, or coupling and uncoupling the opening of the encasement of the first base layer with the second connector of the second encasement.

10. The device of claim 9, wherein in the assembled state, the first base layer and the second base layer are movable with respect to each other.

11. The device of claim 10, wherein in the assembled state, the first base layer is rotatable or slidable with respect to the second base layer to expose the at least one compartment of the encasement of the first base layer for a user to access the product.

12. The device of claim 10, wherein in the assembled state, the first base layer and the second base layer are rotatable to a first alignment in which the first base layer and the second base layer are in a same orientation, wherein the first base layer and the second base layer cannot be uncoupled in the first alignment.

13. The device of claim 12, wherein in the assembled state, the first base layer and the second base layer are rotatable to a second alignment in which the first base layer and the second base layer are in different orientations, wherein the first base layer and the second base layer can be uncoupled in the second alignment.

14. The device of claim 10, wherein in the assembled state, the first base layer and the second base layer are slidable to a first alignment in which the first base layer and the second base layer are fully stacked, wherein the first base layer and the second base layer can be uncoupled in the first alignment.

15. The device of claim 14, wherein in the assembled state, the first base layer and the second base layer are slidable to a second alignment in which the first base layer and the second base layer are off-centered with respect to each other, wherein the first base layer and the second base layer cannot be uncoupled in the second alignment.

16. The device of claim 9, wherein the at least one compartment of the encasement and the at least one second compartment of the second encasement have different configurations.

17. The device of claim 1, wherein the assembled form of the dock and the encasement form a first base layer, the device further comprising:

a plurality of additional base layers, each base layer of the plurality of additional base layers comprising:

a respective dock substantially identical to the dock of the first base layer, and a respective encasement substantially identical to the encasement of the first base layer, wherein each base layer of the plurality of additional base layers is couplable to the first base layer or to any other base layer of the plurality of additional base layers.

18. The device of claim 1, wherein the assembled form of the dock and the encasement form a first base layer, the device further comprising:

a second base layer comprising:

a second dock substantially identical to the dock of the first base layer, and a second encasement substantially identical to the encasement of the first base layer, the second encasement comprising a second connector substantially identical to the connector of the encasement of the first base layer and a second opening substantially identical to the opening of the encasement of first base layer, wherein the first base layer and the second base layer are couplable to each other in an assembled state and are uncouplable from each other by:

coupling and uncoupling the connector of the encasement of the first base layer with the second opening of the second encasement, or coupling and uncoupling the opening of the encasement of the first base layer with the second connector of the second encasement.

19. The device of claim 1, further comprising a wallet configured to open and close, the wallet comprising a connector, wherein the encasement is couplable to and uncouplable from the wallet by coupling and uncoupling the opening of the encasement with the connector of the wallet.

* * * * *